US008869886B2

(12) United States Patent
Streich et al.

(10) Patent No.: US 8,869,886 B2
(45) Date of Patent: Oct. 28, 2014

(54) METHOD TO RESTRICT THE NUMBER OF CYCLES IN A CONTINUOUS J-SLOT IN A DOWNHOLE TOOL

(75) Inventors: Steven G. Streich, Duncan, OK (US); Donald G. Loveday, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 430 days.

(21) Appl. No.: 13/193,334

(22) Filed: Jul. 28, 2011

(65) Prior Publication Data

US 2013/0025882 A1 Jan. 31, 2013

(51) Int. Cl.
*E21B 23/00* (2006.01)
*E21B 41/00* (2006.01)

(52) U.S. Cl.
CPC ..... *E21B 41/00* (2013.01); *E21B 23/006* (2013.01)
USPC ..... 166/240; 166/381

(58) Field of Classification Search
USPC ..... 166/381, 240
See application file for complete search history.

(56) References Cited

U.S. PATENT DOCUMENTS

| | | | |
|---|---|---|---|
| 3,494,418 | A | 2/1970 | Young |
| 3,814,182 | A | 6/1974 | Giroux |
| RE29,471 | E | 11/1977 | Giroux |
| 4,718,494 | A | 1/1988 | Meek |
| 4,989,672 | A | 2/1991 | Burns, Sr. et al. |
| 5,137,087 | A | 8/1992 | Szarka et al. |
| 5,381,862 | A | 1/1995 | Szarka et al. |
| 5,984,014 | A | 11/1999 | Poullard et al. |
| 6,182,766 | B1 | 2/2001 | Rogers et al. |
| 6,367,552 | B1 | 4/2002 | Scott et al. |
| 6,513,589 | B1 | 2/2003 | Hansen et al. |
| 6,540,025 | B2 | 4/2003 | Scott et al. |
| 7,337,852 | B2 | 3/2008 | Manke et al. |
| 2008/0202766 | A1 | 8/2008 | Howell et al. |
| 2010/0243253 | A1 * | 9/2010 | Surjaatmadja et al. ..... 166/298 |

FOREIGN PATENT DOCUMENTS

| | | | |
|---|---|---|---|
| EP | 0399890 | A1 | 11/1990 |
| EP | 0539040 | A2 | 4/1993 |
| EP | 0539040 | A3 | 4/1993 |
| GB | 2267522 | A | 12/1993 |
| GB | 2373269 | A | 9/2002 |
| WO | 2008102117 | A1 | 8/2008 |

OTHER PUBLICATIONS

Office Action dated Mar. 19, 2009 (13 pages), U.S. Appl. No. 11/678,067, filed Feb. 23, 2007.
Office Action dated Sep. 11, 2009 (10 pages), U.S. Appl. No. 11/678,067, filed Feb. 23, 2007.
Foreign communication from a counterpart application—International Search Report and Written Opinion, Jun. 18, 2008, PCT/GB2008/000557, 8 pages.
Foreign communication from a related counterpart application—International Search Report and Written Opinion, PCT/US2012/048001, Oct. 10, 2013, 13 pages.

* cited by examiner

*Primary Examiner* — Brad Harcourt
(74) *Attorney, Agent, or Firm* — John Wustenberg; Conley Rose, P.C.

(57) ABSTRACT

A mechanism for use in a wellbore servicing tool includes a continuously rotating ring within a servicing tool, and a limiting mechanism configured to engage the ring and lock the ring upon a predetermined degree of rotation of the ring. The mechanism may comprise a portion of an actuation assembly for use in a wellbore.

30 Claims, 18 Drawing Sheets

METHOD TO RESTRICT THE NUMBER OF CYCLES IN A CONTINUOUS J-SLOT IN A DOWNHOLE TOOL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A variety of wellbore servicing operations may be performed throughout the life of a wellbore. Each wellbore servicing operation may require one or more downhole tools, each of which may be actuated when positioned within the wellbore. Downhole tools can use their own actuation devices integrated into the tools, or they can use an actuation assembly coupled to the tool. Various actuation assemblies may be operated through longitudinal motion or rotational motion of the tool string or a hydraulic or mechanical force.

Problems may arise when running such actuation assemblies into a wellbore. Dragging of the tool string may create one of the input forces and cause premature actuation of the tools, which can lead to potential damage to the tools and/or the wellbore. Even if the tool string can be positioned in place without actuating the tool or tools, subsequent motion may inadvertently actuate and deactivate the tools. This problem may be evident on offshore installations that are subject to wave motion and periodic cycling of the tool string.

SUMMARY

In one aspect, the present disclosure is directed to a mechanism for use in a wellbore servicing tool comprising a continuously rotating ring within a servicing tool; and a limiting mechanism configured to engage the ring and lock the ring upon a predetermined degree of rotation of the ring. The limiting mechanism may comprise a pin configured to engage a corresponding recess disposed on the ring upon an alignment of the pin and the corresponding recess. The mechanism may also include a biasing mechanism to bias the pin into contact with the ring. The predetermined degree of rotation of the ring may be less than or equal to a single rotation of the ring. The limiting mechanism may also comprise a follower disk comprising a follower pin, where the follower pin is configured to engage a guide feature disposed on the ring. The guide feature may comprise a groove with an end wall, and the limiting mechanism may be configured to lock the ring upon the engagement of the follower pin with the end wall of the groove. The predetermined degree of rotation of the ring in this embodiment may be less than or equal to four rotations of the ring. The limiting mechanism may also comprise a ratchet mechanism that may be activated by an indicator disposed on the ring, and the ratchet mechanism may be configured to release a retaining pin that engages a recess disposed on the ring upon a predetermined number of activations of the ratchet mechanism. The limiting mechanism may be configured to lock the ring upon the engagement of the retaining pin with the recess. The predetermined degree of rotation of the ring in this embodiment may be less than or equal to seven rotations of the ring. The limiting mechanism may also comprise a geared wheel comprising a plurality of gears and a guide, where the gears may be configured to engage an indicator disposed on the ring. The guide may be configured to engage a recess disposed on the ring upon a predetermined number of activations of the geared wheel, where the limiting mechanism may be configured to lock the ring upon engagement of the guide with the recess. In this embodiment, the predetermined degree of rotation of the ring may be less than or equal to nine rotations of the ring.

In another aspect, the present disclosure is directed to an actuation assembly for use in a wellbore comprising: an inner mandrel comprising a continuous slot; a rotating lug ring comprising a lug, where the rotating lug ring is disposed about the inner mandrel and the lug engages the continuous slot; and a limiting mechanism configured to engage the rotating lug ring and lock the rotating lug ring upon a predetermined degree of rotation of the rotating lug ring about the inner mandrel. The actuation assembly may also include an outer mandrel disposed about the inner mandrel and the rotating lug ring, where the limiting mechanism may be disposed within the outer mandrel. The continuous slot may be a continuous J-slot. The actuation assembly may also include a servicing tool coupled to the actuation assembly. In an embodiment, the limiting mechanism may comprise a pin configured to engage a corresponding recess disposed on the rotating lug ring upon an alignment of the pin and the corresponding recess. In this embodiment, the predetermined degree of rotation of the rotating lug ring may be configured to provide less than or equal to two setting/unsetting cycles of the servicing tool. In another embodiment, the limiting mechanism may comprise a follower disk comprising a follower pin, where the follower pin is configured to engage a groove disposed on the rotating lug ring. The predetermined degree of rotation of the rotating lug ring may be configured to provide less than or equal to eight setting/unsetting cycles of the servicing tool. In still another embodiment, the limiting mechanism may comprise a ratchet mechanism configured for activation by an indicator disposed on the rotating lug ring, and the ratchet mechanism may be configured to allow a retaining pin to engage a recess disposed on the rotating lug ring upon a predetermined number of activations of the ratchet mechanism. The limiting mechanism may be configured to lock the rotating lug ring upon the engagement of the retaining pin with the recess. In this embodiment, the predetermined degree of rotation of the rotating lug ring and the predetermined number of activations of the ratchet mechanism may be configured to provide less than or equal to fourteen setting/unsetting cycles of the servicing tool. In yet another embodiment, the limiting mechanism may comprise a geared wheel comprising a plurality of gears and a guide, where the gears may be configured to engage an indicator disposed on the rotating lug ring. The guide may be configured to engage a recess disposed on the rotating lug ring upon a predetermined number of activations of the geared wheel and the limiting mechanism may be configured to lock the ring upon engagement of the guide with the recess. In this embodiment, the predetermined degree of rotation of the rotating lug ring and the predetermined number of activations of the geared wheel may be configured to provide less than or equal to eighteen setting/unsetting cycles of the servicing tool.

In another aspect, the present disclosure is directed to a method of servicing a wellbore comprising: placing an actuation assembly coupled to a servicing tool within a wellbore, wherein the actuation assembly comprises a continuous slot; activating the servicing tool a first predetermined number of times with the actuation assembly; and locking the actuation assembly into a position after activating the servicing tool the first predetermined number of times. The continuous slot may be a continuous J-slot. The actuation assembly may comprise a geared wheel comprising a plurality of gears and a guide, and the gears may be configured to engage an indicator disposed on a rotating lug ring that engages the continuous slot. Locking the actuation assembly may comprise engaging the guide with a recess disposed on the rotating lug ring upon activating the servicing tool the first predetermined number of times to lock the rotating lug ring upon engagement of the guide with the recess. The predetermined number of times may be less than or equal to eighteen activations of the servicing tool. The method may also include removing the actuation assembly from the wellbore; resetting the actuation assembly; replacing the actuation assembly coupled to the servicing tool within the wellbore; activating the servicing tool a second predetermined number of times with the actuation assembly; and locking the actuation assembly into a second position after activating the servicing tool the second predetermined number of times. The first predetermined number of times and the second predetermined number of times may be different.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
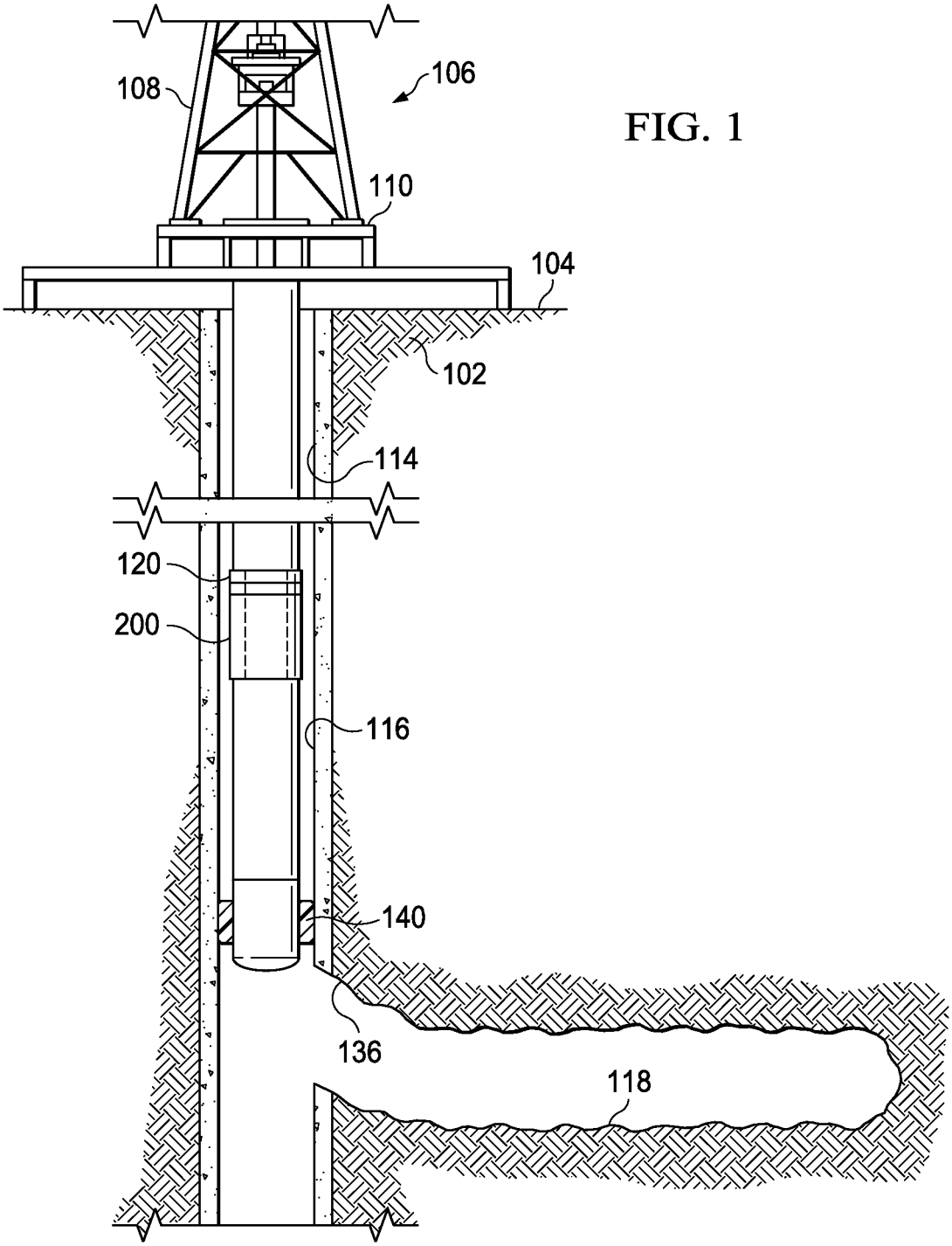
FIG. 1 is a simplified cross-sectional view of an embodiment of a wellbore servicing apparatus in an operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of this description with "in," "inward," or "inner" meaning towards the center or central longitudinal axis of the wellbore tubular and with "out," "outward," and "outer" meaning towards the wellbore wall or away from the central longitudinal axis of the wellbore tubular. As used herein, "service," "servicing," or "servicing operation" refers to any operation or procedure used to drill, complete, work over, fracture, repair, or in any way prepare or restore a wellbore for the recovery of materials residing in a subterranean formation penetrated by the wellbore. A "servicing tool" refers to any tool or device used to service a wellbore or used during a servicing operation. The various characteristics mentioned above, as well as other features and characteristics described in more detail below, will be readily apparent to those skilled in the art with the aid of this disclosure upon reading the following detailed description of the embodiments, and by referring to the accompanying drawings.

Referring to FIG. 1, an example of a wellbore operating environment in which an actuation assembly 200 may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells.

A wellbore tubular string 120 comprising an actuation assembly 200 may be lowered into the subterranean formation 102 for a variety of servicing operations throughout the life of the wellbore 114. The embodiment shown in FIG. 1 illustrates the wellbore tubular 120 in the form of a production tubing string comprising the actuation assembly 200 coupled to a settable packer 140 disposed in the wellbore 114. It should be understood that the wellbore tubular 120 comprising the actuation assembly 200 is equally applicable to any type of wellbore tubular being inserted into a wellbore as part of a servicing procedure using an actuatable tool (e.g., a valve, packer, plug, auxiliary tool, or any tool requiring different positions), including as non-limiting examples drill pipe, casing, rod strings, and coiled tubing. Further, a means of isolating the interior of the wellbore tubular string 120 from the annular region between the wellbore tubular string 120 and the wellbore wall 114 and/or various portions of the annular region throughout the wellbore may take various forms. For example, a zonal isolation device such as a packer (e.g., packer 140), may be used to isolate the interior of the wellbore tubular string 120 from the annular region to control the flow of a fluid through the wellbore tubular 120 and/or the annular region.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 within the wellbore 114 and to position the wellbore tubular 120 at a selected depth. While the operating environment depicted in FIG. 1 refers to a stationary workover and/or drilling rig 106 for conveying the wellbore tubular 120 comprising the actuation assembly 200 within a land-based wellbore 114, in alternative embodiments, mobile workover rigs, wellbore servicing units (such as coiled tubing units), and the like may be used to convey the wellbore tubular 120 comprising the actuation assembly 200 within the wellbore 114. It should be understood that a wellbore tubular 120 comprising the actuation assembly 200 may alternatively be used in other operational environments, such as within an offshore wellbore operational environment.

Figure 2:
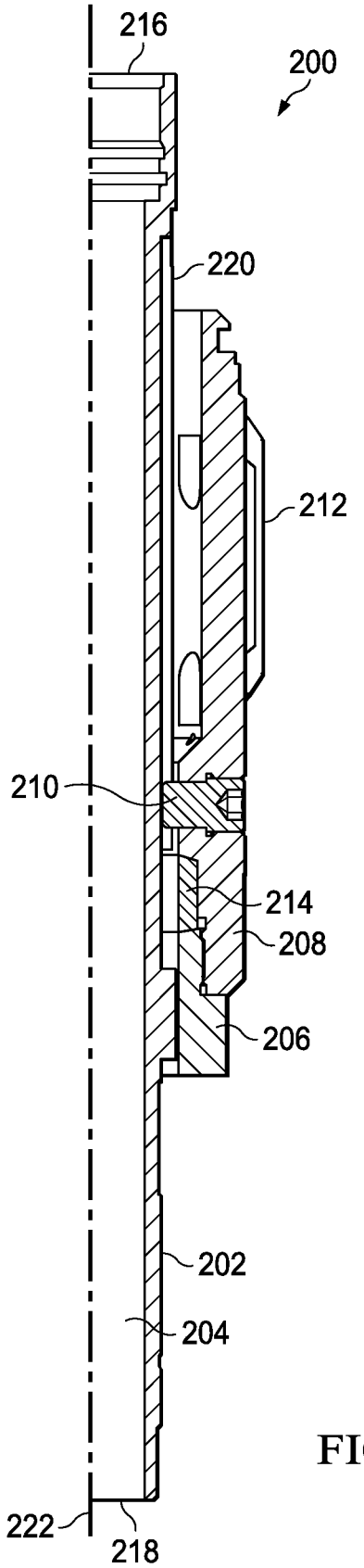
FIG. 2 is a half cross-section showing an embodiment of an actuation assembly.

Regardless of the type of operational environment in which the actuation assembly 200 is used, it will be appreciated that the actuation assembly 200 comprises a limiting mechanism and serves to provide a relative movement for actuating a downhole tool or component, and is configured to restrict the number of times that the downhole tool or component may be actuated between a set position and an unset position. As shown in FIG. 2, the actuation assembly 200 may comprise an inner mandrel 202, a retaining member 206, an outer mandrel 208, an alignment pin 210, a rotating lug ring 214, and one or more retaining devices 212. In an embodiment, the actuation assembly 200 may form part of a wellbore tubular string. A first end 216 of the actuation assembly 200 may be configured to engage the wellbore tubular 120 while a second end 218 may be configured to engage a tool, tool string, wellbore component, or another wellbore tubular 120.

The inner mandrel 202 may comprise elongated tubular body member having a flowbore 204 that allow for fluid to flow between the first end 216 to the second end 218 through the actuation assembly 200. The outer mandrel 208 is disposed around the inner mandrel 202 and may engage a retaining member 206 with the rotating lug ring 214 held in position between the outer mandrel and the retaining member 206 and disposed around the inner mandrel 208. In an embodiment, the outer mandrel 208 and the retaining member 206 may be removably attached to one another, fixedly attached to one another, or even integrally formed with one another. One or more lugs disposed on an inner surface of the rotating lug ring 214 may engage a slot 220 disposed on an outer surface of the inner mandrel 202. An alignment pin 210 may be disposed in the outer mandrel 208 and engage the slot 220. The alignment pin 210 may travel longitudinally (e.g., coaxially with the wellbore tubular along axis 222) in the slot 220 to maintain an alignment between the inner mandrel 202 and the outer mandrel 208. The alignment pin 210 and slot 220 arrangement allows the inner mandrel 202 to move longitudinally along the axis 222 of the wellbore tubular, but prevent rotational movement of the inner mandrel 202 beyond the limits of the slot 220. One or more retaining devices 212 may be disposed on an outer surface of the outer mandrel 208 and act to retain the actuation assembly 200 within the wellbore through contact with an externally disposed wellbore tubular and/or the wellbore wall. In an embodiment, the retaining devices 212 may comprise drag blocks, slips, packing elements, springs, or other such retaining members that may engage a casing and/or a wellbore wall in which the actuation assembly 200 is disposed, thereby preventing or limiting longitudinal movement of the actuation assembly 200 within the wellbore. A limiting mechanism may be disposed in the outer mandrel 208 and may be configured to engage the rotating lug ring 214 upon a predetermined degree of movement of the one or more lugs within the slot 220, as described in more detail below.

In an embodiment, slot 220 is a continuous slot, such as a continuous J-slot, a control groove, or an indexing slot. As used herein, a continuous slot refers to a slot extending entirely about (i.e., 360 degrees) the circumference of the inner mandrel 202, though not necessarily in a single straight path. An exemplary continuous J-slot is shown in a flattened view in FIG. 3. A continuous J-slot refers to a design in which several lug 304 positions are possible corresponding to an actuated state and an un-actuated state of the actuation assembly 200 and in which the lug 304 is capable of engaging the slot 220 throughout an entire rotation of the rotating lug ring 214. The actuated state of the actuation assembly 200 may correspond to the set position of a servicing tool coupled to the actuation assembly 200, and the un-actuated state of the actuation assembly 200 may correspond to the unset position of the servicing tool coupled to the actuation assembly 200. The lug 304 may slide in response to a longitudinal force on the inner mandrel 202. The lug 304 may prevent the inner mandrel 202 from moving beyond the range allowed by the slot 220 due to the physical interaction between the lug 304 with the edge 302 of the slot 220. The actuated state of the actuation assembly 200 may be determined by the rotational position of the lug 304 on the rotating lug ring 214, which rotates due to angles in the edge 302 of the slot 220 that rotate the lug 304 and the rotating lug ring 214 as the inner mandrel 202 is longitudinally cycled. For example, when the lug 304 is in position 306 the inner mandrel 202 may be raised to bring the lower portion of the slot into contact with the lug 304. Upon contacting the sloped edge of the lower portion of the slot 220, the lug 304 may rotate until it is in position 310. The inner mandrel 202 may then be lowered to bring the upper portion of the slot 220 into engagement with the lug 304. The lug 304 may then rotate into position 308 due to the slop of the upper portion of the slot 220. The overall cycling of the inner mandrel 202 in a downward and upward motion then results in the lug 304 rotating from position 306 to position 308. The lug 304 may be positioned at the various positions of the slot 220 through one or more partial (e.g., lifting the inner mandrel or lowering the inner mandrel) or complete cycles of longitudinal motion of the inner mandrel 202 with respect to the outer mandrel 208 and the rotating lug ring 214.

The slot 220 may have several positions depending on the number of actuated states required for a servicing tool coupled to the actuation assembly. In an embodiment, the slot 220 may have two positions, which may correspond to an activated or set position and a deactivated or unset position. In an embodiment, the slot 220 may have three or more positions, which may correspond to different longitudinal travel distances of the slot. In this embodiment, two or more of the positions may correspond to two or more activated or set configurations of the servicing tool and at least one position may correspond to a deactivated or unset position. In an embodiment, the unset position may be position 306 shown in FIG. 3. From this position, the lug 304 may rotate through position 310 to a set position at position 308 in response to a longitudinal cycling of the inner mandrel 202. Location 310 results from a partial cycling of the inner mandrel 202 and represents the lug 304 position during a half cycle of the inner mandrel 202. The additional longitudinal distance traveled by the inner mandrel 202 at position 308 relative to position 306 may be transferred to one or more servicing tools or components coupled to the actuation assembly 200, thereby actuating the one or more servicing tools or components. In an embodiment, one or more components may be used to maintain the lug 304 in the actuated position 308, such as a spring or piston. Alternatively, the wellbore tubular may be maintained in a desired position at the surface of the well to maintain the lug 304 in the actuated position 308. Upon another longitudinal cycling of the inner mandrel 202, the lug 304 may rotate through location 312 into an unset position similar to position 306.

Figure 3:
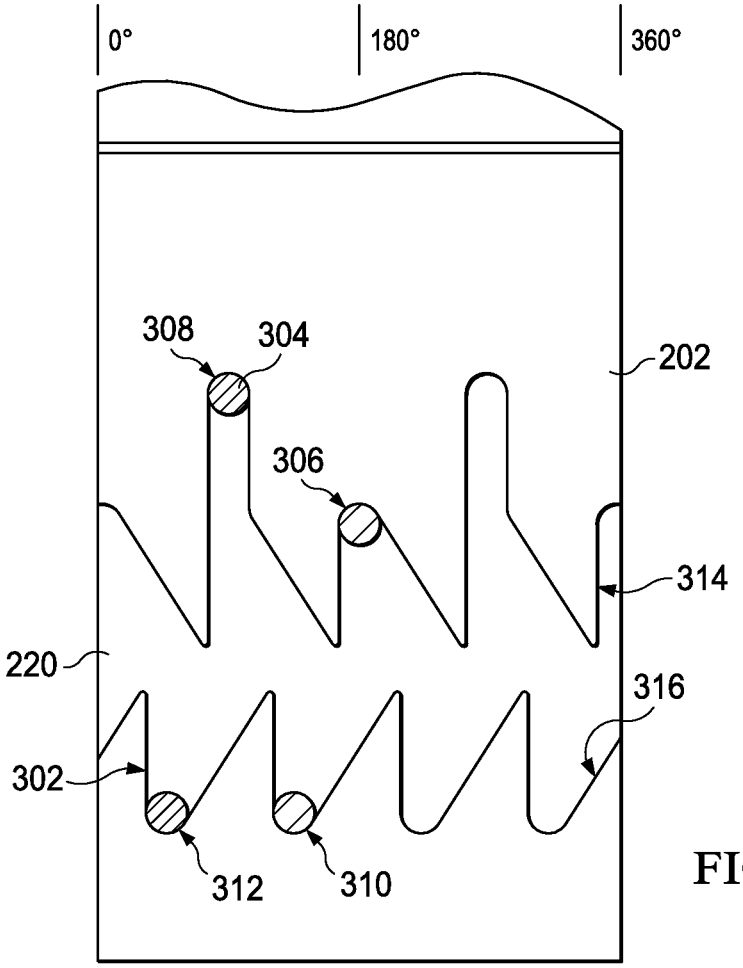
FIG. 3 illustrates the angular positions of an embodiment of a continuous J-slot with various pin positions.

In the embodiment shown in FIG. 3, four complete longitudinal cycles (e.g., raising and lowering, or lowering and raising) of the inner mandrel 202 result in a single complete rotation of the rotating lug ring 214. The four complete longitudinal cycles would result in two setting actuations and two unsetting actuations. In an embodiment, additional slot positions may be present along with a corresponding lug configuration to allow more or less than two complete setting and unsetting actuations per complete rotation of the rotating lug ring 214. For example, three, four, or five complete setting and unsetting actuations may be obtained per complete rotation of the rotating lug ring 214 by incorporating six, eight, or ten positions (e.g., using alternating set and unset positions) in the slot 220, respectively. In an embodiment, partial cycles are also possible through the use of an odd number of positions (e.g., 5, 7, 9, or 11 positions) in the slot 220.

In an embodiment, one or more lugs 304 may be disposed on the rotating lug ring 214. In an embodiment, a single lug 304 is disposed on the rotating lug ring 214 and rotates through the slot 220. In other embodiments, two lugs are disposed on the rotating lug ring 214 and may be disposed on opposite sides of the rotating lug ring 214. When an even number of slot positions are present, the slot positions on opposite sides of the inner mandrel 202 may correspond to the same set or unset position. The two lugs may then both engage a set position or an unset position, which may provide additional mechanical support within the actuation assembly 200 for the one or more servicing tools or components coupled to the actuation assembly 200. In still other embodiments three or more lugs may be used with the actuation assembly 200 described herein.

In an embodiment, a limiting mechanism is configured to engage the rotating lug ring 214 upon a predetermined degree of movement of the one or more lugs within the slot 220, which is related through the design of the slot 220 to the amount of rotation of the rotating lug ring 214. Upon engaging the rotating lug ring 214, the limiting mechanism may prevent further rotational movement of the rotating lug ring 214. The actuation assembly 200 may then be locked into position due to the arrangement of the lug 304, the slot 220, and the alignment pin 210. For example, the inner mandrel 202 may be free to move with a limited degree of longitudinal motion due to the physical interaction between the locked lug 304 with an upper slot surface 314 and a lower slot surface 316. Since the lug 304 is locked into position, the rotating lug ring 214 will not rotate in response to the interaction of the lug with the upper slot surface 312 or the lower slot surface 316, but rather will substantially prevent any further relative motion between the outer mandrel 208 and the inner mandrel 202. In an embodiment, the limiting mechanism may be used to engage and lock a continuously rotating ring within a downhole tool upon a predetermined degree of rotation of the ring. In an embodiment, the limiting mechanism may be used to limit or control the number of times that the actuation assembly 200 may be actuated between a set position and an unset position, which may be used to actuate a servicing tool or component between a set position and an unset position.

Figure 4:
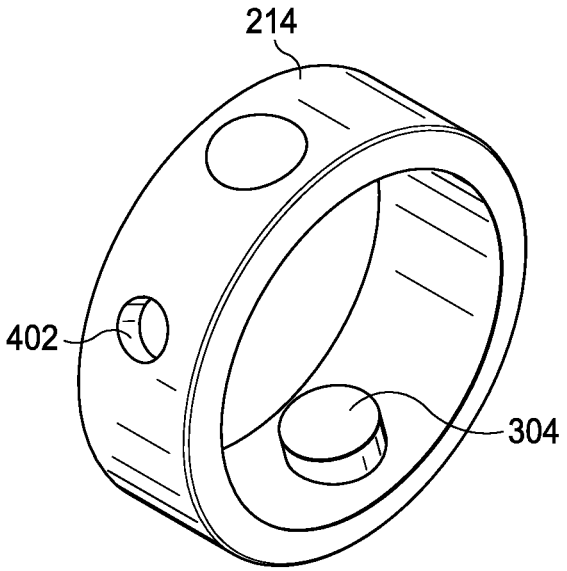
FIG. 4 illustrates an isometric view of an embodiment of a rotating lug ring.
Figure 5:
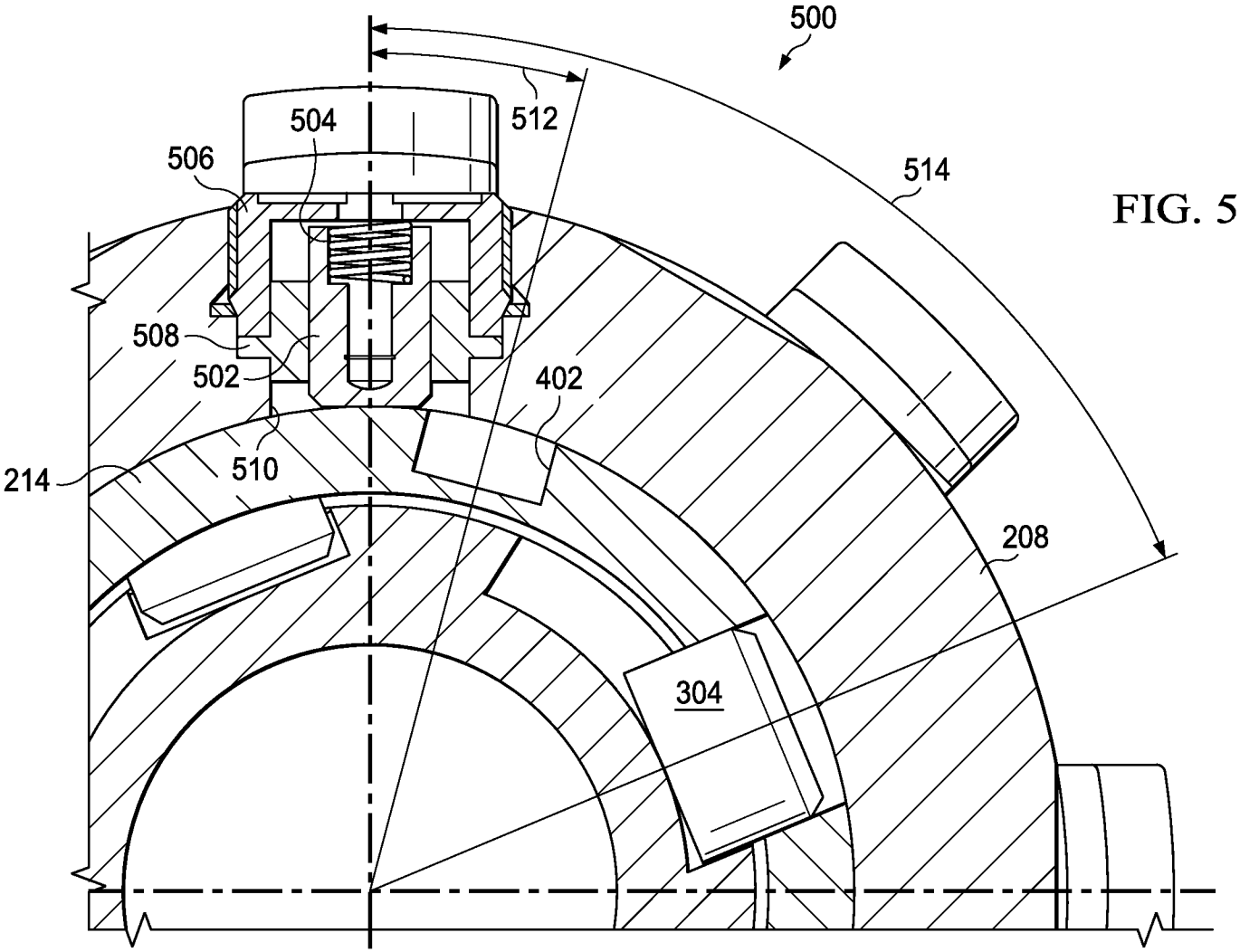
FIG. 5 illustrates an orthographic cross section of an embodiment of an actuation assembly.
Figure 6:
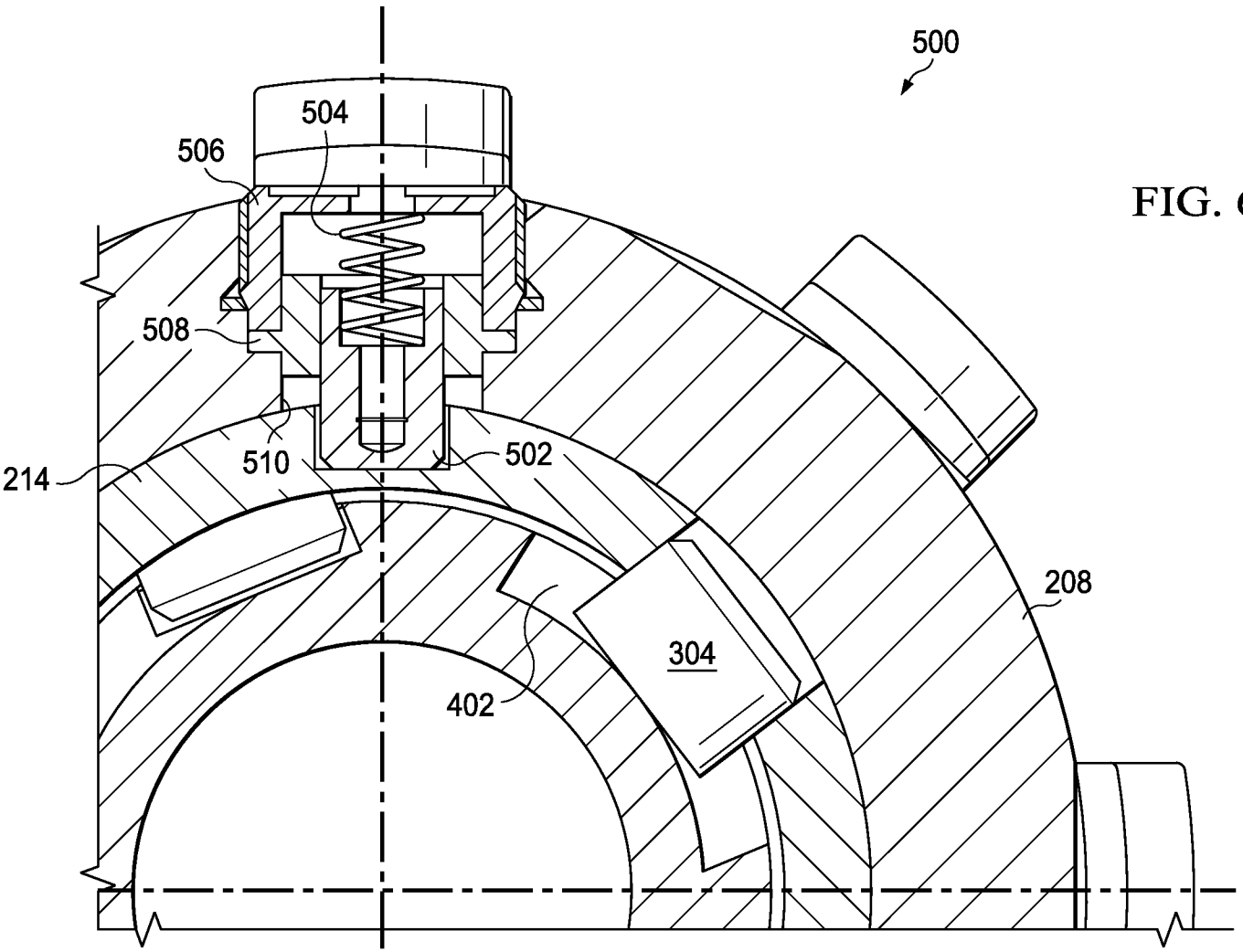
FIG. 6 illustrates another orthographic cross section of an embodiment of an actuation assembly.
Figure 7:
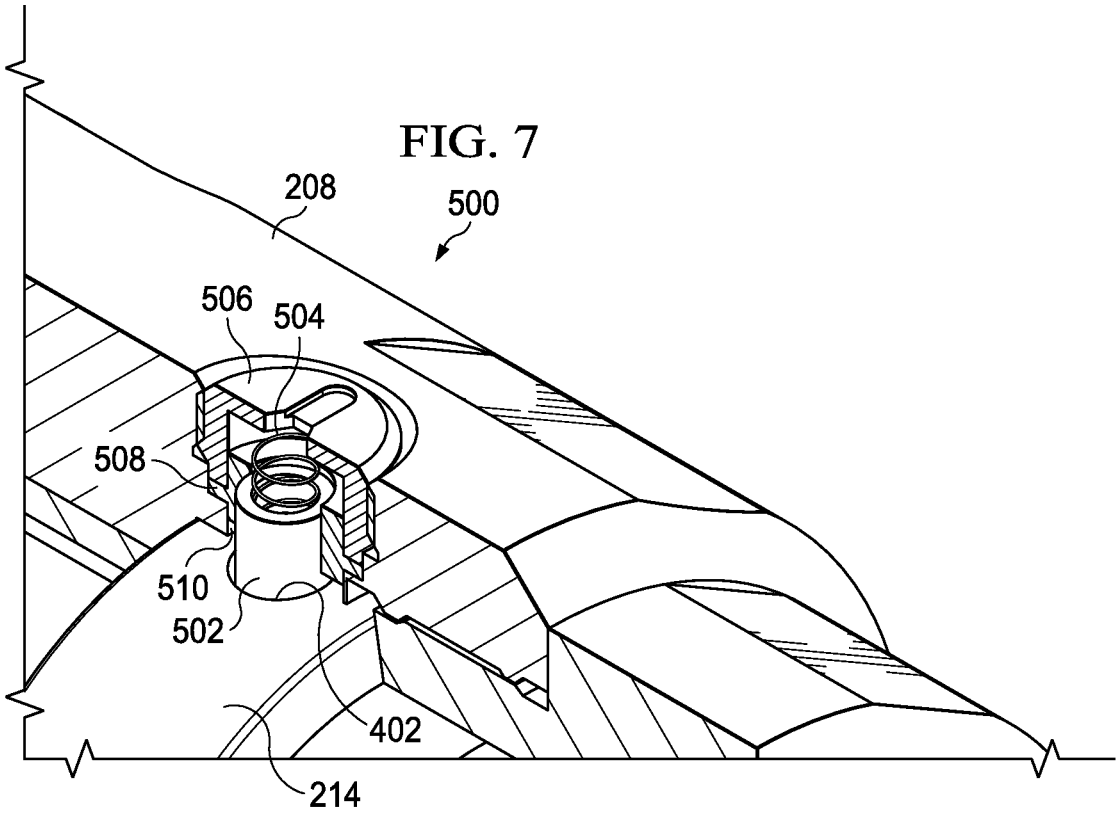
FIG. 7 illustrates an isometric partial cross section of an actuation assembly according to an embodiment of the present disclosure.

An embodiment of a limiting mechanism 500 is illustrated in FIGS. 4-7. In this embodiment, the limiting mechanism 500 comprises a pin 502 that engages a corresponding recess 402 disposed in the rotating lug ring 214. As shown in FIG. 4, the rotating lug ring 214 comprises a recess 402 disposed in an outer surface of the rotating lug ring 214. The recess 402 may correspond in shape with the pin 502, and the recess 402 may extend entirely through the rotating lug ring 214 or only a portion thereof. As shown in FIG. 5, the limiting mechanism 500 comprises the pin 502, a biasing mechanism 504, and a retaining member 506. In an embodiment, the retaining member 506 may comprise an alignment member 508 that may be integrally formed with the retaining member 506. The limiting mechanism 500 may be disposed within a corresponding recess 510 disposed in the outer mandrel 208. The pin 502 may be retained within the recess 510 and in alignment with the rotating lug ring 214 by the alignment member 508. The retaining member 506 may engage the outer mandrel 208 using a threaded connection or other coupling means, and may be arranged to retain the pin 502 and alignment member 508 within the recess 510 and adjacent to the rotating lug ring 214. The biasing mechanism 504 (e.g., a spring, elastomeric element, or the like) may engage the pin 502 and the retaining member 506 so that the pin 502 is biased towards the rotating lug ring 214. The pin 502 may slide upon the outer diameter of the rotating lug ring 214 as the rotating lug ring 214 rotates in response to the lug following the slot 220 during longitudinal movement of the inner mandrel 202. Upon rotation of the recess 402 on rotating lug ring 214 into alignment with the pin 502 as shown in FIGS. 6 and 7, the biasing means may bias the pin 502 into engagement with the recess 402, thereby preventing any further rotation of the rotating lug ring 214 and locking the actuation assembly 200 into a desired position.

When the limiting mechanism 500 is in the engaged position, the actuation assembly may be conveyed out of the wellbore, and the limiting mechanism 500 may be reset for one or more additional uses by removing the retaining member 506 and raising the pin out of engagement with the recess 402. The rotating lug ring 214 may then be repositioned to a desired initial position. The limiting mechanism 500 may then be replaced within the outer mandrel 208 and the retaining member 506 may be re-engaged with the outer mandrel 208. The reset actuation assembly may then be re-used within the wellbore.

The initial positioning of the limiting mechanism 500 relative to the rotating lug ring 214 may be chosen to allow for a desired number of settings and/or unsettings of the actuation assembly 200. While this embodiment may allow for up to a single rotation of the rotating lug ring 214, partial rotations may also be obtained. This may allow for the maximum number of setting and unsetting cycles to be used, or alternatively, any portion of the maximum number of setting and unsetting cycles. In an embodiment, the limiting mechanism 500 may be initially aligned with the rotating lug ring 214 at any position allowing for nearly a complete rotation of the rotating lug ring 214. The initial positioning may be measured by an angle 512 that measures the radial angular difference between the center of recess 402 and the center of pin 502. In an embodiment, this angle 512 may vary from about 10 degrees to about 350 degrees, alternatively from about 10 degrees to about 190 degrees. By aligning the pin 502 and recess 402 at an initial angle of between about 10 degrees and about 20 degrees, the actuation assembly 200 may be cycled through the set and unset positions several full cycles. For example, the continuous J-slot shown in FIG. 3 allows for a maximum of two setting and unsetting cycles for each rotation of the rotating lug ring 214. By aligning the pin 502 and recess 402 at an initial angle of between about 180 degrees and 200 degrees, the actuation assembly 200 may be cycled through the set and unset positions one full cycle. Additional initial angular positions may be chosen to allow for partial actuations using the continuous slot 220.

While the embodiment shown in FIG. 5 is described in terms of a pin 502 engaging a recess 402, additional configurations may be used to achieve the same result of limiting the rotation of the rotating lug ring 214 to a single rotation or some portion thereof. In an embodiment, a groove may be disposed in the rotating lug ring 214 with a stop position. Upon sufficient rotation of the rotating lug ring 214, the pin may contact the end of the groove, thereby limiting any further rotation. Alternatively, the rotating lug ring may comprise a protrusion on the surface rather than a recess. Upon sufficient rotation of the rotating lug ring, the protrusion may engage the pin, thereby limiting any further rotation.

Figure 8A:
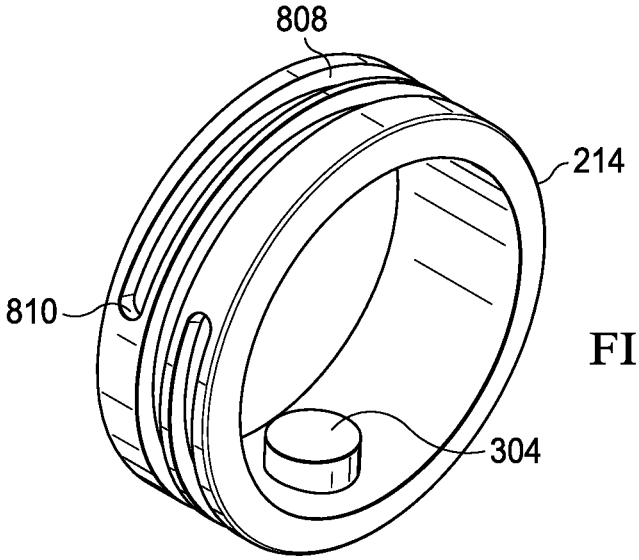
FIG. 8A illustrates an isometric view of a rotating lug ring according to an embodiment of the present disclosure.
Figure 8B:
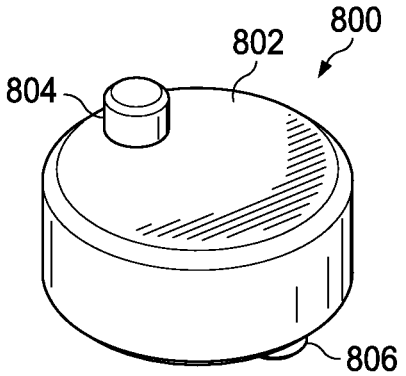
FIG. 8B illustrates an isometric view of a limiting mechanism according to an embodiment of the present disclosure.
Figure 8C:
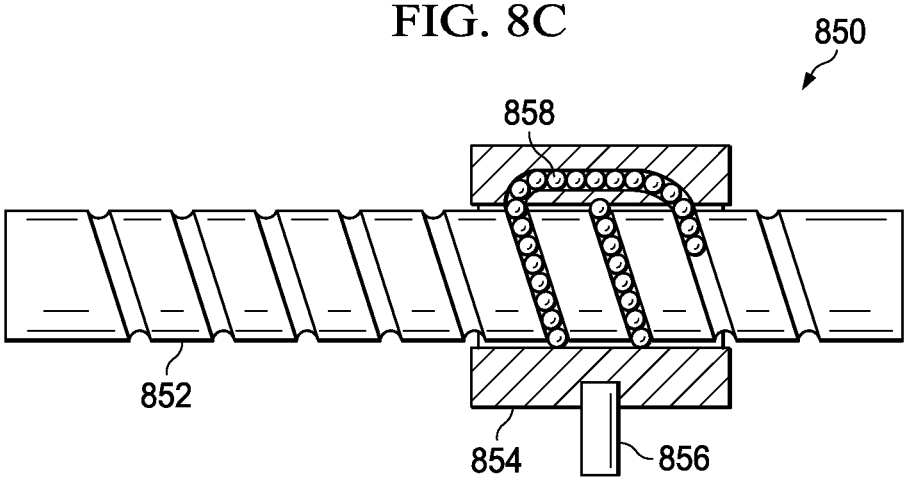
FIG. 8C illustrates a cross-sectional view of a limiting mechanism according to an embodiment of the present disclosure.
Figure 9:
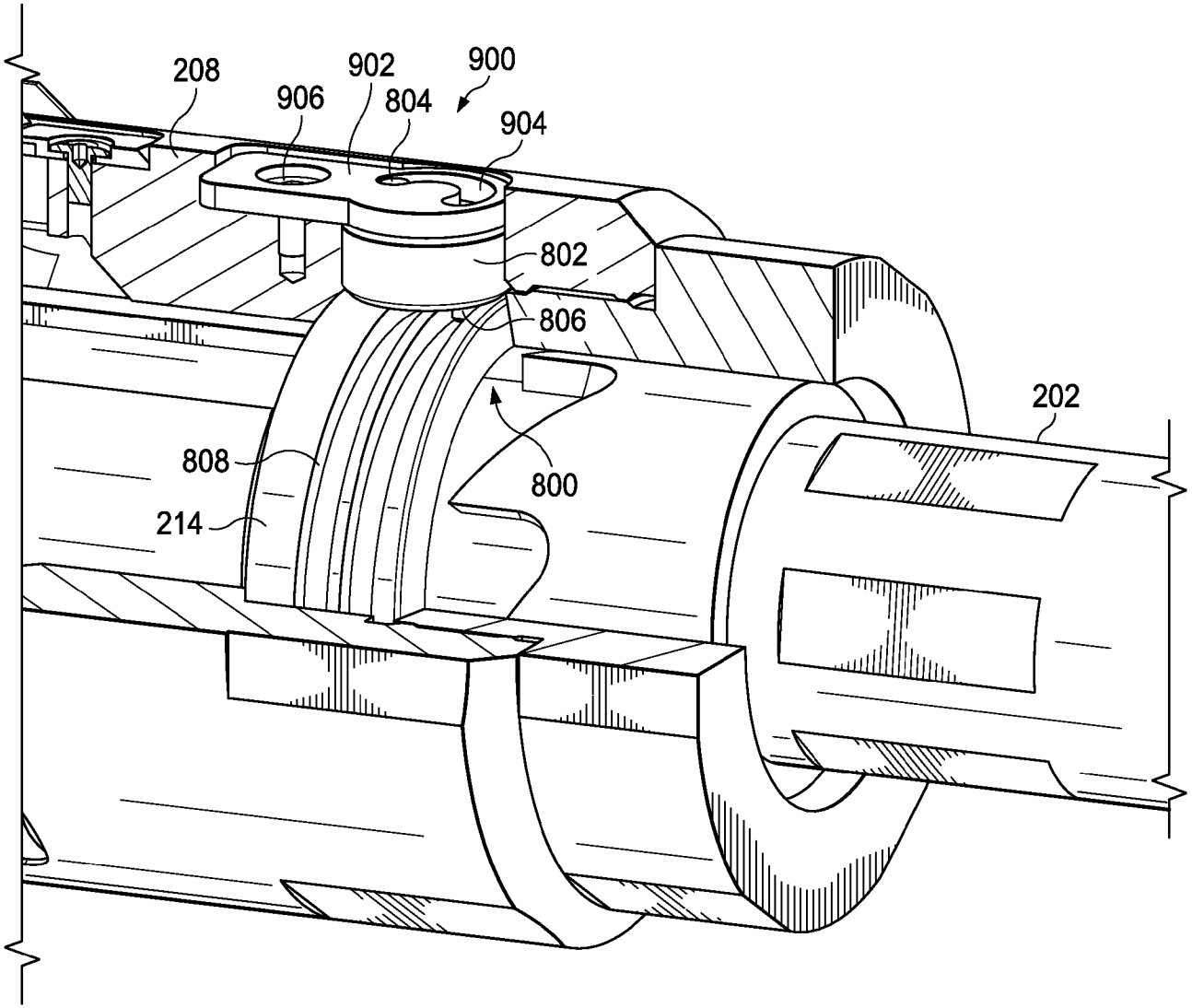
FIG. 9 illustrates an isometric partial cross section of an actuation assembly according to an embodiment of the present disclosure.
Figure 10:
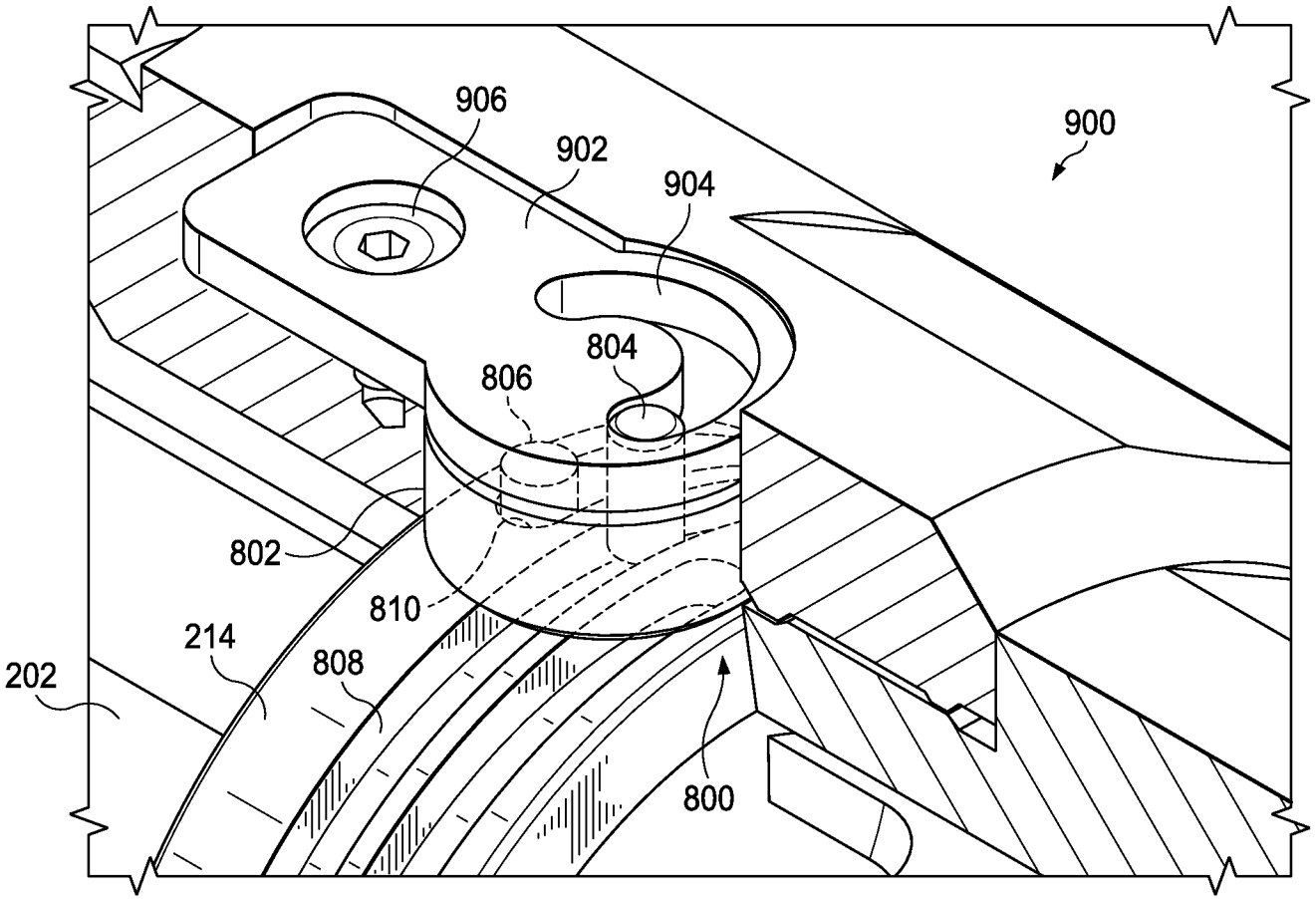
FIG. 10 illustrates another isometric partial cross section of an actuation assembly according to an embodiment of the present disclosure.

Another embodiment of the limiting mechanism 800 is illustrated in FIGS. 8-10. In this embodiment, the limiting mechanism 800 comprises a follower disk 802 comprising a follower pin 806 and an optional guide pin 804. The follower pin 806 engages a corresponding guide feature, which in an embodiment comprises a groove 808 disposed in the rotating lug ring 214. The groove 808 may extend around the circumference of the rotating lug ring 214 one or more times. For example, the groove 808 may be a helical groove and may extend around the rotating lug ring 214 one time, two times, three times, or four times. In an embodiment, the groove 808 may extend around the rotating lug ring 214 in one or more complete rotations and/or in increments of partial complete rotations (e.g., 0.1, 0.2, 0.3, 0.4, 0.5, 0.6, 0.7, 0.8, or 0.9 rotations). The choice of the number of rotations of the groove 808 may be used to control and/or limit the number of setting and unsetting cycles of the actuation assembly 200, as described in more detail below.

The limiting mechanism 800 comprises a follower disk 802 comprising a follower pin 806 and an optional guide pin 804. The follower disk 802 may comprise a cylindrical body and may have one or more beveled edges to allow the follower disk 802 to rotate within a corresponding recess in the outer mandrel 208. The follower pin 806 may generally comprise a cylindrical extension to allow for the rotation within the groove 808. The guide pin 804 may generally comprise a milled protrusion or extension that may have a complementary shape to the guide channel 904 to allow for engagement of the guide pin 804 with the guide channel 904. The follower pin 806 and the guide pin 804 may engage the follower disk 802 at or near an edge of the follower disk 802 with each pin being disposed on opposite faces of the follower disk 802. The follower disk 802 may be configured to allow the follower pin 806 to engage the groove 808 along its entire length, or any portion thereof. In general, the follower disk 802 may comprise a greater diameter as the length of the groove 808 (e.g., the number of rotations) around the rotating lug ring 214 increases.

As shown in FIGS. 8 and 9, the rotating lug ring 214 is disposed around the inner mandrel 202 in the manner described above. In this embodiment, the limiting mechanism 800 is disposed in the outer mandrel 208 adjacent to the rotating lug ring 214. The limiting mechanism 800 may be retained in position adjacent the rotating lug ring 214 using a retaining mechanism 900. The retaining mechanism 900 may comprise a retaining cover 902 configured to maintain the follower disk 802 adjacent to and in alignment with the rotating lug ring 214 in the outer mandrel 208. In an embodiment, the retaining cover 902 of the retaining mechanism 900 may be held in place by a connector 906 (e.g., a screw, pin, latch, rivet, button, etc.). In an embodiment, the retaining mechanism 900 may be removable for removal and resetting of the follower disk 802 and the follower pin 806 within the groove 808. The guide pin 804 may engage and travel within the guide channel 904 disposed within the retaining mechanism 900. While optional, the guide channel 904 and guide pin 804 combination may be useful in directing the rotation of the follower disk 802 during actuation of the actuation assembly 200.

In operation, the follower pin 806 may engage the groove 808, and the guide pin 804 may engage the guide channel 904 in the retaining mechanism 900. An exemplary initial positioning of the assembly is shown in FIG. 9. Upon rotation of the rotating lug ring 214 due to the longitudinal cycling of the inner mandrel 202, the follower pin 806 may slidingly engage and travel along the groove 808. The follower pin 806 may travel in the groove 808 and rotate the follower disk 802 as the pin moves in the groove 808 in a longitudinal direction along the longitudinal axis of the inner mandrel 202. The rotation of the follower disk 802 may also cause the guide pin 804 to travel within the guide channel 904. The combination of the guide pin 806 and the guide channel 904 may be used to limit the rotation of the follower disk 802 to a single direction, which may reduce the potential for prematurely locking the rotating lug ring 214 in position.

Upon following the groove 808 during the rotation of the rotating lug ring 214, the follower pin 806 may engage the end wall 810 of the groove 808 as shown in FIG. 10. The interaction of the follower pin 806 and the end wall 810 may prevent any further rotational movement of the rotating lug ring 214. In an embodiment, the guide pin 804 may engage the end of the guide channel 904 at a position corresponding to the engagement of the follower pin 806 with the end wall 810 of the groove 808. The additional engagement of the guide pin 804 with the end of the guide channel 904 may also prevent any further rotation of the follower disk 802 and the rotating lug ring 214. As described above, the actuation assembly may be locked into a desired position as a result of the follower pin 806 engaging the end wall 810 of the groove 808.

When the limiting mechanism 800 is in the locked position, the actuation assembly may be conveyed out of the wellbore, and the limiting mechanism 800 may be reset for an additional use. The limiting mechanism 800 may be reset by removing the retaining mechanism 900 and the follower disk 802, and replacing the follower disk 802 with the follower pin 806 in the desired position within the groove 808. The retaining mechanism 900 may then be re-engaged with the outer mandrel 208 to provide an actuation assembly configured for use within the wellbore.

The initial positioning of the limiting mechanism 800 and the follower pin 806 relative to the groove 808 in the rotating lug ring 214 may be chosen to allow for a desired number of setting and/or unsetting actuations of the actuation assembly. This ability to select an initial follower pin 806 position may allow for multiple rotations of the rotating lug ring 214 and/or any degree of rotations less than the maximum number of rotations based on the length of the groove 808. Control of the number of rotations of the rotating lug ring 214 may allow for the maximum number of setting and unsetting cycles of the actuation assembly to be used, or alternatively, any portion of the maximum number of setting and unsetting cycles of the actuation assembly. In an embodiment, the follower pin 806 may be initially aligned with the groove 808 in the rotating lug ring 214 at or near the beginning of the groove 808 to allow for a nearly complete rotation of the rotating lug ring 214 along the length of the groove 808. For example, the groove 808 illustrated in the rotating lug ring 214 in FIGS. 9 and 10 allows for two complete rotations of the rotating lug ring 214 about the inner mandrel 202. As a further example, the use of two complete rotations with the continuous J-slot shown in FIG. 3 allows for a maximum of four setting and unsetting cycles of the actuation assembly. By aligning the follower pin 806 half way along the length of the groove 808 shown in FIGS. 9 and 10, the actuation assembly may be cycled through the set and unset positions two full cycles. By aligning the follower pin 806 three quarters of the way along the length of the groove 808, the actuation assembly may be cycled through the set and unset positions one full cycle. In an embodiment, the use of a groove extending around the rotating lug ring 214 three times may provide for up to six setting/unsetting cycles of the actuation assembly, and a groove extending around the rotating lug ring 214 four times may provide for up to eight setting/unsetting cycles of the actuation assembly. Additional positions of the follower pin 806 in the groove 808 may allow for half cycles and/or additional cycles through the addition of one or more additional whole or partial rotations of the groove 808 in the rotating lug ring 214.

In an embodiment, the number of slots in the inner mandrel 202 may be varied from the configuration shown in FIG. 3 to allow for more or less settings and unsettings per rotation of the rotating lug ring 214. Thus, the configuration of the inner mandrel 202, the rotating lug ring 214, and the limiting mechanism 800 may be coordinated to allow for a desired maximum number of setting/unsetting cycles of the actuation assembly. The actuation assembly may then be configured to allow for any portion of the maximum number of setting/unsetting cycles by proper selection of the initial follower pin location in the groove 808.

While the embodiment shown in FIGS. 8-10 is described in terms of a follower pin engaging a groove, additional configurations may be used to achieve the same result of limiting the rotation of the rotating lug ring 214. In an embodiment illustrated in FIG. 8C, the limiting mechanism 850 may comprise a linear actuator that may be used to provide the longitudinal movement of the follower pin 856 in the groove 808. In an embodiment, the linear actuator may comprise a ball screw 854 and threaded shaft 852. The ball screw 854 comprises a mechanical linear actuator that translates rotational motion of the threaded shaft 852 to linear motion of the ball screw 854. The threaded shaft 852 may comprise a helical raceway for ball bearings 858, which may act to reduce the friction as the ball screw 854 moves along the threaded shaft 852. The ball assembly acts as the nut while the threaded shaft 852 is the screw. In an embodiment, the ball screw 854 may comprise a threaded nut without ball bearings 858 and the threaded shaft 852 may comprise corresponding threads that engage the threads in the ball screw 854. The locking mechanism 850 may be disposed in the outer mandrel 208 with the axis of the threaded screw 852 in alignment with the axis of the inner mandrel 202. The pin 856 may be disposed on the ball screw 854 and may engage the groove 808 on the rotating lug ring 214. Upon actuation of the rotating lug ring 214, the pin 856 disposed about the threaded shaft 852 may translate along the threaded shaft 852 to allow the pin to follow the groove 808. The rotating lug ring 214 may be locked upon the interaction of the pin 856 with the end of the groove 810 in the same manner as described above with respect to the follower pin 806 and the end of the groove 810.

Still other embodiments are possible. For example, a protrusion or rail may be disposed on the outer surface of the rotating lug ring and may be used to cause the follower disk to rotate and lock the rotating lug ring into position after a predetermined amount of rotation.

Still another embodiment of the limiting mechanism 1200 is illustrated in FIGS. 11-14. In this embodiment, the limiting mechanism 1200 is a ratchet mechanism comprising a retaining pin 1202 slidingly engaged within a central bore of a ratchet 1204. The lower surface of the retaining pin 1202 slidingly engages the rotating lug ring 214, which comprises an indicator 1102 within the surface configured to translate the retaining pin 1202 within the ratchet 1204. In an embodiment, each translation of the retaining pin 1202 may result in a single activation of the ratchet 1204. Upon a sufficient number of actuations, outer pin extensions 1206 may engage a slot 1214 in the ratchet 1204 and allow the retaining pin 1202 to move towards the rotating lug ring 214. The retaining pin 1202 may then engage a corresponding recess 1104 on the rotating lug ring 214 to prevent or limit any further rotation of the lug ring 214. The ratchet 1204 may be configured to allow the retaining pin 1202 to engage the slot 1214 in the rotating lug ring after a predetermined number of activations, as described in more detail below.

Figure 11:
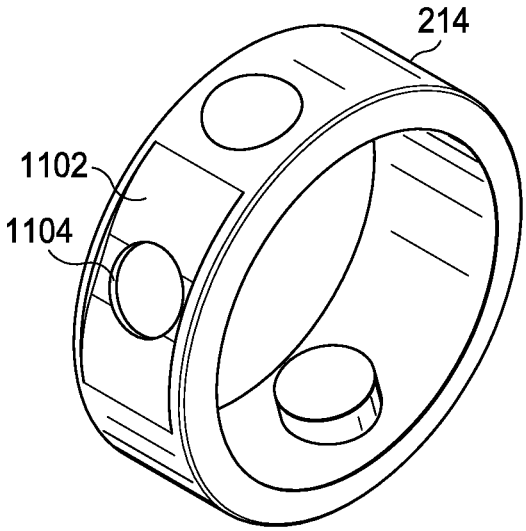
FIG. 11 illustrates an isometric view of a rotating lug ring according to an embodiment of the present disclosure.

In an embodiment shown in FIG. 11, the rotating lug ring 214 may comprise an indicator 1102 and a retaining pin recess 1104 disposed on the outer surface of the rotating lug ring 214. In an embodiment, the indicator 1102 may comprise a flattened portion of the outer surface of the rotating lug ring 214. The flattened portion may activate the retaining pin 1202 by allowing the retaining pin 1202 to move towards the rotating lug ring 214 over the flattened portion as the rotating lug ring 214 rotates due to the longitudinal translation of the inner mandrel 202 and the interaction of the lugs with the J-slot. In an embodiment, more than one indicator 1102 may be disposed on the outer surface of the rotating lug ring 214.

Figure 12:
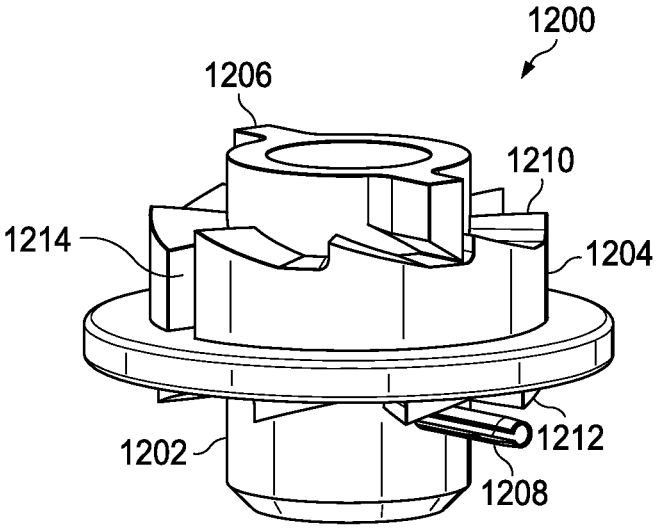
FIG. 12 illustrates an isometric view of a limiting mechanism according to an embodiment of the present disclosure.

In an embodiment as shown in FIG. 12, the ratchet mechanism may comprise a ratchet 1204 having outer teeth 1210 and inner teeth 1212. The outer teeth 1210 may be uniform but asymmetrical, with each outer tooth 1210 having a slope on one edge and a steeper slope on the other edge. A valley may be created between each adjacent outer tooth 1210. Similarly, the inner teeth 1212 may be uniform but asymmetrical, with each inner tooth 1212 having a slope on one edge and a steeper slope on the other edge. A valley may be created between each adjacent inner tooth 1212. The teeth 1210, 1212 and the corresponding valleys between adjacent teeth are offset between the outer teeth 1210 and the inner teeth 1212.

The retaining pin 1202 may generally comprise a cylindrical body corresponding to a generally cylindrical bore formed within the ratchet 1204. The lower edge of the retaining pin 1202 may have beveled or otherwise rounded edge, which may aid the sliding engagement between the retaining pin 1202 and the rotating lug ring 214. The retaining pin 1202 may comprise an inner bore or the retaining pin 1202 may be solid. Outer pin extensions 1206 disposed on the retaining pin 1202 may engage the outer teeth 1210, and inner pin extensions 1208 disposed on the retaining pin 1202 may engage the inner teeth 1212. Outer pin extensions 1206 may be disposed at or near an outer edge of the retaining pin 1202. The outer pin extensions 1206 may be cylindrical or they may comprise a square, rectangular, or trapezoidal shape. In an embodiment as shown in FIG. 12, the outer pin extensions 1206 may generally be rectangular, though the inner surface of the outer pin extensions 1206 may have a beveled edge with a slope that matches the less steep slope of the outer teeth 1210. This configuration may allow the outer pin extensions 1206 to slide on the outer teeth 1210 during actuation of the limiting mechanism 1200. Similarly, inner pin extensions 1208 may be disposed at or near an inner edge of the retaining pin 1202. The inner pin extensions 1208 may be cylindrical or they may comprise a square, rectangular, or trapezoidal shape. In an embodiment as shown in FIG. 12, the inner pin extensions 1208 may generally be cylindrical. In an embodiment, the retaining pin 1202 may have one or more outer pin extensions 1206 and/or inner pin extensions 1208. For example, the retaining pin 1202 may comprise one, two, three, four, or more outer pin extensions 1206 and/or inner pin extensions 1208. The number of pin extensions may be configured to correspond to the number of outer teeth 1210 and/or inner teeth 1212, respectively, along with the number and location of one or more slots 1214 in the ratchet 1204.

Figure 13:
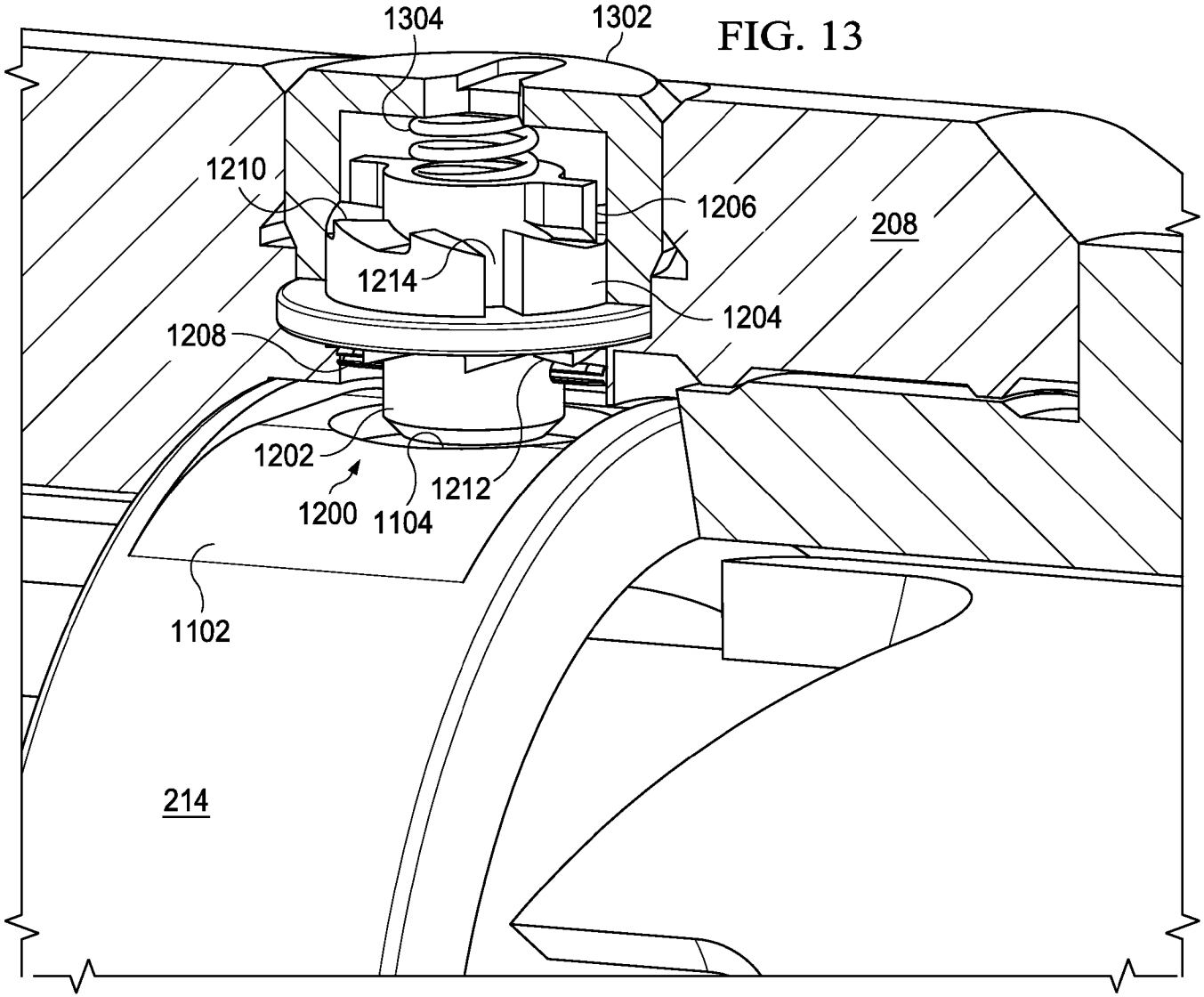
FIG. 13 illustrates another isometric partial cross section of an actuation assembly according to an embodiment of the present disclosure.

With reference to FIG. 13, the retaining pin 1202 may move inward as the indicator 1102 on the rotating lug ring 214 engages the retaining pin 1202 and allows the outer pin extensions 1206 to engage outer teeth 1210 during activation. Due to the asymmetry between the edges of each outer tooth 1210, the outer pin extensions 1206 may slidingly engage the edge of an outer tooth 1210 and slide into a valley between adjacent outer teeth 1210, thereby rotating the retaining pin 1202 within the ratchet 1204. When the retaining pin 1202 moves outwards due to the outer surface of the rotating lug ring 214 engaging the retaining pin 1202, the inner pin extensions 1208 may engage the inner teeth 1212. The inner pin extensions 1208 may engage the inner teeth 1212 along a portion of the less steeply sloped edge due to the offset between the inner teeth 1212 and the outer teeth 1210. Due to the asymmetry between the edges of each inner tooth 1212, the inner pin extension 1208 may slidingly engage the edge of an inner tooth 1212 and slide into a valley between adjacent inner teeth 1212, thereby rotating the retaining pin 1202 within the ratchet 1204. Each activation of the limiting mechanism 1200 may result in the outer pin extensions 1206 and/or the inner pin extensions 1208 rotating to a subsequent valley between adjacent outer teeth 1210 and/or inner teeth 1212, respectively.

As shown in FIG. 13, the limiting mechanism 1200 may be disposed in the outer mandrel 208 adjacent the rotating lug ring 214 using a retaining mechanism 1302. The retaining mechanism 1302 may be configured to retain the ratchet mechanism in position adjacent to the rotating lug ring 214 and may engage the outer mandrel 208 using a threaded connection, a pressure fitted connection, or any other connection known to one of ordinary skill in the art. The retaining mechanism 1302 may engage the ratchet 1204 within the outer mandrel 208 and retain the ratchet 1204 in a stationary position within the outer mandrel 208. A biasing mechanism 1304 may be disposed between the outer surface of the retaining pin 1202 and the retaining mechanism 1302 to bias the retaining pin 1202 inward towards the rotating lug ring 214. In an embodiment, the biasing mechanism 1304 may comprise a spring, elastomeric element, or the like.

Figure 14:
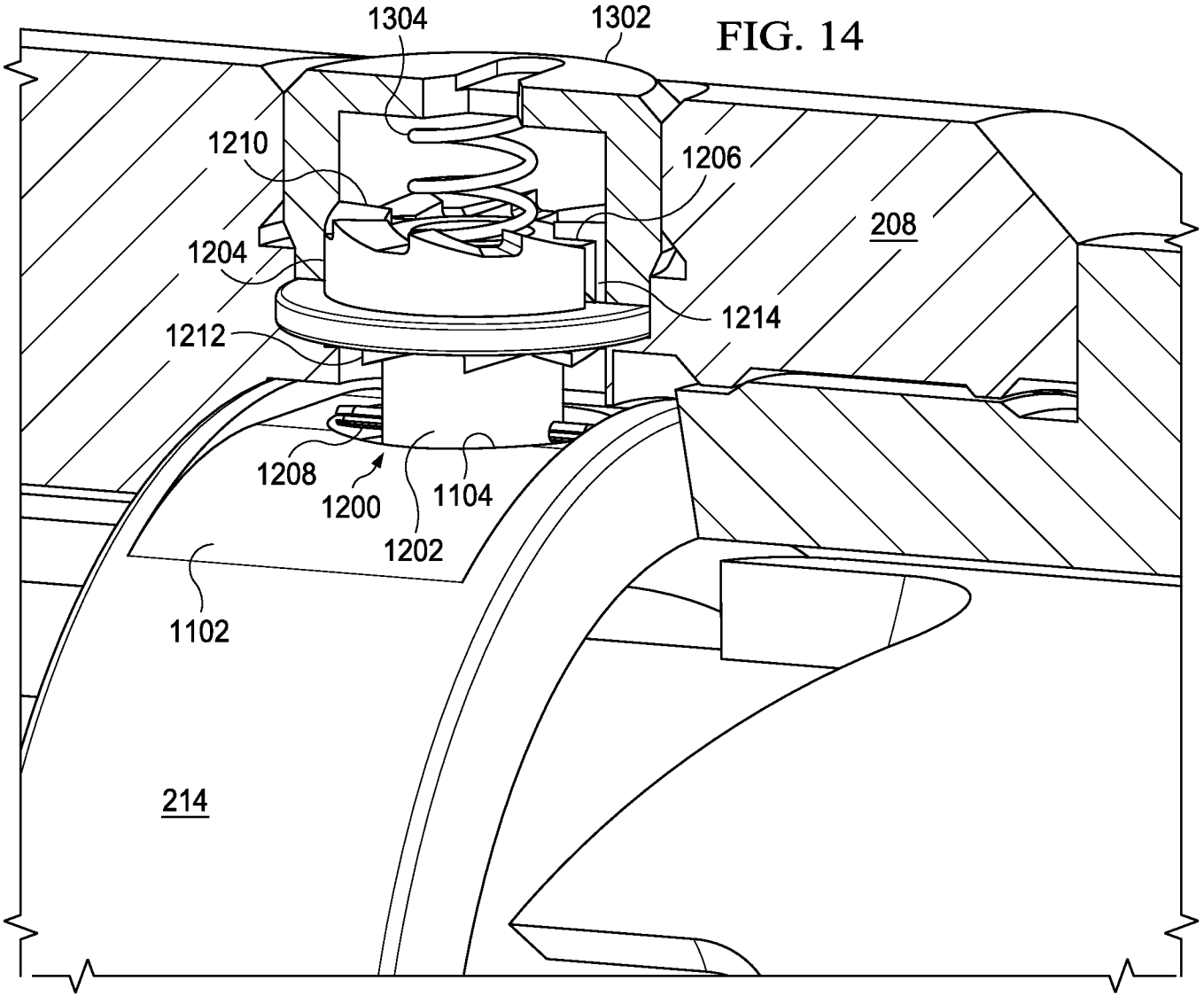
FIG. 14 illustrates still another isometric partial cross section of an actuation assembly according to an embodiment of the present disclosure.

In an embodiment, the slot 1214 may be disposed in the ratchet 1204 in a valley between adjacent outer teeth 1210. As shown in FIG. 14, the outer pin extensions 1206 may engage the slot 1214 upon rotating into position through an activation cycle, thereby allowing the retaining pin 1202 to translate towards the rotating lug ring 214. The retaining pin 1202 may then engage a corresponding recess 1104 on the retaining lug ring 214. The interaction between the retaining pin 1202 and the corresponding recess 1104 on the retaining lug ring 214 may prevent any further rotation of the rotating lug ring 214, locking the actuation assembly into position.

When the actuation assembly is in the locked position, the actuation assembly may be conveyed out of the wellbore, and the limiting mechanism 1200 may be reset for an additional use. The limiting mechanism 1200 may be reset by removing the retaining mechanism 1302 and repositioning the retaining pin 1202 and corresponding outer pin extensions 1206 to the desired location on the ratchet 1204. The biasing mechanism 1304 and retaining mechanism 1302 may then be re-engaged with the outer mandrel 208 to provide an actuation assembly configured for use within the wellbore.

The number of teeth in the ratchet 1204 may determine the maximum number of actuations of the limiting mechanism 1200 that can be used to lock the actuation assembly. In the embodiment shown in FIGS. 13 and 14, eight outer teeth 1210 and eight inner teeth 1212 are used to allow for three actuation cycles (e.g., three rotations of the rotating lug ring 214) until the outer pin extensions 1206 engage the slot 1214 in the ratchet 1204. The eight outer teeth 1210 define a starting position, two intermediate valley positions, and a final position in which the outer pin extensions 1206 may engage the slot 1214 to allow the retaining pin 1202 to engage the corresponding recess 1104 in the rotating lug ring 214. It can be seen that a greater number of teeth on the ratchet 1204 may allow for a greater number of activations of the limiting mechanism 1200, and a related number of rotations of the rotating lug ring 214, prior to locking of the actuation assembly. In an embodiment, the ratchet 1204 may comprise ten outer teeth, twelve outer teeth, fourteen outer teeth, or sixteen outer teeth and a corresponding number of inner teeth 1212 to allow for a maximum number of four actuation cycles of the limiting mechanism 1200, five actuation cycles of the limiting mechanism 1200, six actuation cycles of the limiting mechanism 1200, or seven actuation cycles of the limiting mechanism 1200, respectively. In an embodiment, the ratchet 1204 and the rotating lug ring 214, and the slot 220 on the inner mandrel may be configured to provide a maximum number of six, eight, ten, twelve, or fourteen setting/unsetting actuation cycles of the actuation assembly. Conversely, fewer teeth may result in less actuation cycles of the limiting mechanism 1200. In an embodiment, six outer teeth and a corresponding number of inner teeth may be used to allow for a maximum number of two actuation cycles of the limiting mechanism 1200.

The initial positioning of the limiting mechanism 1200 and the pin extensions 1206, 1208 relative to the ratchet 1204 may be chosen to allow for a desired number of settings and/or unsettings of the actuation assembly. The use of a limiting mechanism 1200 comprising a ratchet 1204 may allow for multiple rotations of the rotating lug ring 214, and selection of the initial pin extension 1206, 1208 positions relative to the ratchet 1204 and ratchet teeth 1210, 1212 may allow for any degree of rotation equal to or less than the maximum number of rotations that can be obtained. In an embodiment, the outer pin extensions 1206 may be initially disposed in a valley adjacent the slot 1214 in the ratchet 1204. This position may allow for the maximum number of actuations of the ratchet 1204 and limiting mechanism 1200. For example, the positioning of the outer pin extensions 1206 as shown in FIG. 13 may result in three actuations of the limiting mechanism 1200 through three full rotations of the rotating lug ring 214 prior to the outer pin extensions 1206 engaging the slot 1214 in the ratchet 1204 and the retaining pin 1202 engage the recess 1104 in the rotating lug ring 214, thereby locking the actuation assembly. In an embodiment using the continuous J-slot shown in FIG. 3, the three full rotations of the rotating lug ring 214 may allow for a maximum of six setting/unsetting cycles of the actuation assembly.

In an embodiment, the outer pin extensions 1206 may be initially disposed in the second valley from the slot 1214 in the ratchet 1204. This position may allow for less than the maximum number of actuations of the ratchet 1204 and limiting mechanism 1200. For example, the positioning of the outer pin extensions 1206 in the second valley from the slot 1214 in the ratchet 1204 illustrated in FIG. 13 may result in two actuations of the limiting mechanism 1200 through two full rotations of the rotating lug ring 214 prior to the outer pin extensions 1206 engaging the slot 1214 in the ratchet 1204 and the retaining pin 1202 engaging the recess 1104 in the rotating lug ring 214, thereby locking the actuation assembly. In an embodiment using the continuous J-slot shown in FIG. 3, the two full rotations of the rotating lug ring 214 may allow for four setting/unsetting cycles of the actuation assembly.

In an embodiment, the outer pin extensions 1206 may be initially disposed in the third valley from the slot 1214 in the ratchet 1204. This position may also allow for less than the maximum number of actuations of the ratchet 1240 and limiting mechanism 1200. For example, the positioning of the outer pin extensions 1206 in the third valley from the slot 1214 in the ratchet 1204 illustrated in FIG. 13 may result in one actuation of the limiting mechanism 1200 through one full rotation of the rotating lug ring 214 prior to the outer pin extensions 1206 engaging the slot 1214 in the ratchet 1204 and the retaining pin 1202 engaging the recess 1104 in the rotating lug ring 214, thereby locking the actuation assembly. In an embodiment using the continuous J-slot shown in FIG. 3, the one full rotation of the rotating lug ring 214 may allow for two setting/unsetting cycles of the actuation assembly.

Additional features may allow for half setting/unsetting cycles and/or additional setting/unsetting cycles. In an embodiment, the use of two indicators 1102 disposed on different halves of the rotating lug ring 214 may allow for two actuations of the limiting mechanism 1200 for each rotation of the rotating lug ring 214. An odd number of setting/unsetting cycles may then be achieved using the limiting mechanism 1200. In an embodiment, three or more indicators 1102 may be disposed on different portions of the rotating lug ring 214. For example, four indicators 1102 may be used to achieve four actuations of the limiting mechanism 1200 for each rotation of the rotating lug ring 214. This embodiment may allow for half actuation cycles to be achieved (e.g., a setting or an unsetting of the actuation assembly). When configured with a suitable number of teeth, the limiting mechanism 1200 may be configured to allow for a plurality of full and/or partial actuation cycles, which may allow for a plurality of full and/or partial setting/unsetting cycles of the actuation assembly. Thus, the configuration of the inner mandrel 202, the rotating lug ring 214, and the limiting mechanism 1200 (e.g., the number of teeth, pin extensions, slots, etc.) may be coordinated to allow for a desired maximum number of setting/unsetting cycles of the actuation assembly. The actuation assembly may then be configured to allow for any portion of the maximum number of setting/unsetting cycles by proper selection of the initial pin extension placement with respect to the slot 1214 in the ratchet 1204.

While the embodiment shown in FIGS. 11-14 is described in terms of a retaining pin engaging an indicator and a recess in the rotating lug ring, additional configurations may be used to achieve the same result of limiting the rotation of the rotating lug ring. In an embodiment, the retaining pin may be rotationally fixed while allowing for movement along the central axis of the ratchet. In this embodiment, the ratchet may be configured to rotate within the outer mandrel, thereby allowing the slot to rotate into position with the pin extensions and lock the rotating lug ring. In an embodiment, both the retaining pin and the ratchet may be free to rotate. In this embodiment, the rotating lug ring may be locked upon alignment of the slot with the pint extensions. In an embodiment, the indicator may comprise a protrusion disposed on the outer surface of the rotating lug ring and the protrusion may be used to cause the retaining pin to actuate within the ratchet. In an embodiment, the limiting mechanism may be disposed on the rotating lug ring, and an actuation feature and locking indicator may be disposed in the outer mandrel. Upon a sufficient actuation of the limiting mechanism on the rotating lug ring, the retaining pin may engage a locking indicator on the outer mandrel, thereby locking the actuation assembly.

Yet another embodiment of the limiting mechanism 1600 is illustrated in FIGS. 15-21. In this embodiment, the limiting mechanism 1600 comprises a geared wheel 1602 with a guide 1604. The rotating lug ring 214 comprises an indicator 1502 disposed on the outer surface of the rotating lug ring 214 and adjacent a recess 1504 disposed on an edge of the rotating lug ring 214. In combination, the indicator 1502 actuates the geared wheel 1602, resulting in a partial rotation of the geared wheel 1602 with each rotation of the rotating lug ring 214. Upon a predetermined number of rotations of the rotating lug ring 214, the guide 1604 engages the recess 1504 to prevent any further rotation of the rotating lug ring 214, thereby locking the actuation assembly. The geared wheel 1602 may be configured to allow the guide 1604 to engage the recess 1504 in the rotating lug ring 214 after a predetermined number of activations, as described in more detail below.

Figure 15:
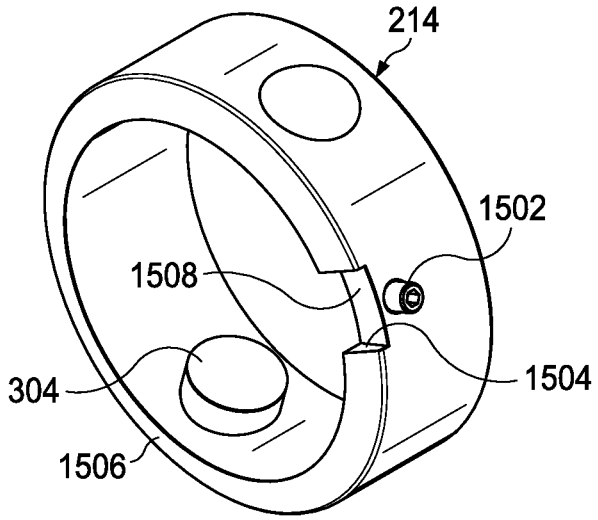
FIG. 15 illustrates an isometric view of a rotating lug ring according to still another embodiment of the present disclosure.
Figure 16:
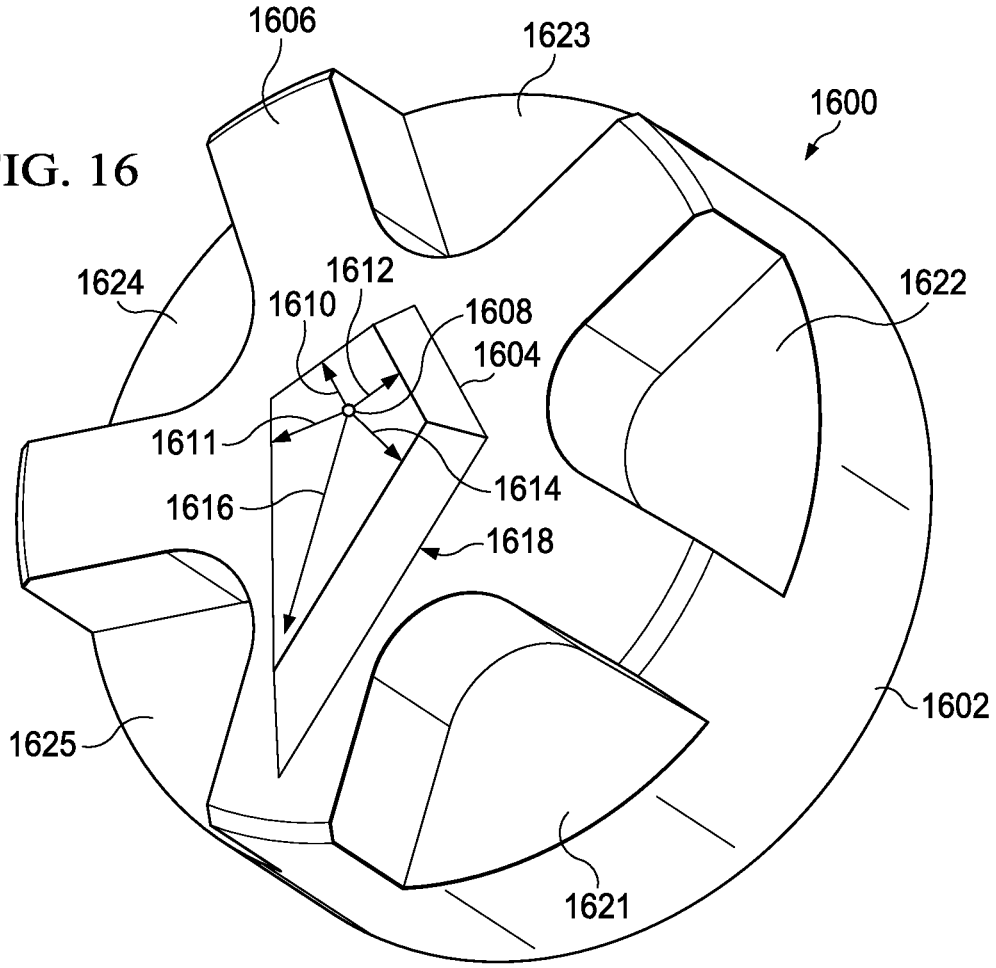
FIG. 16 illustrates an isometric view of a limiting mechanism according to still another embodiment of the present disclosure.
Figure 17:
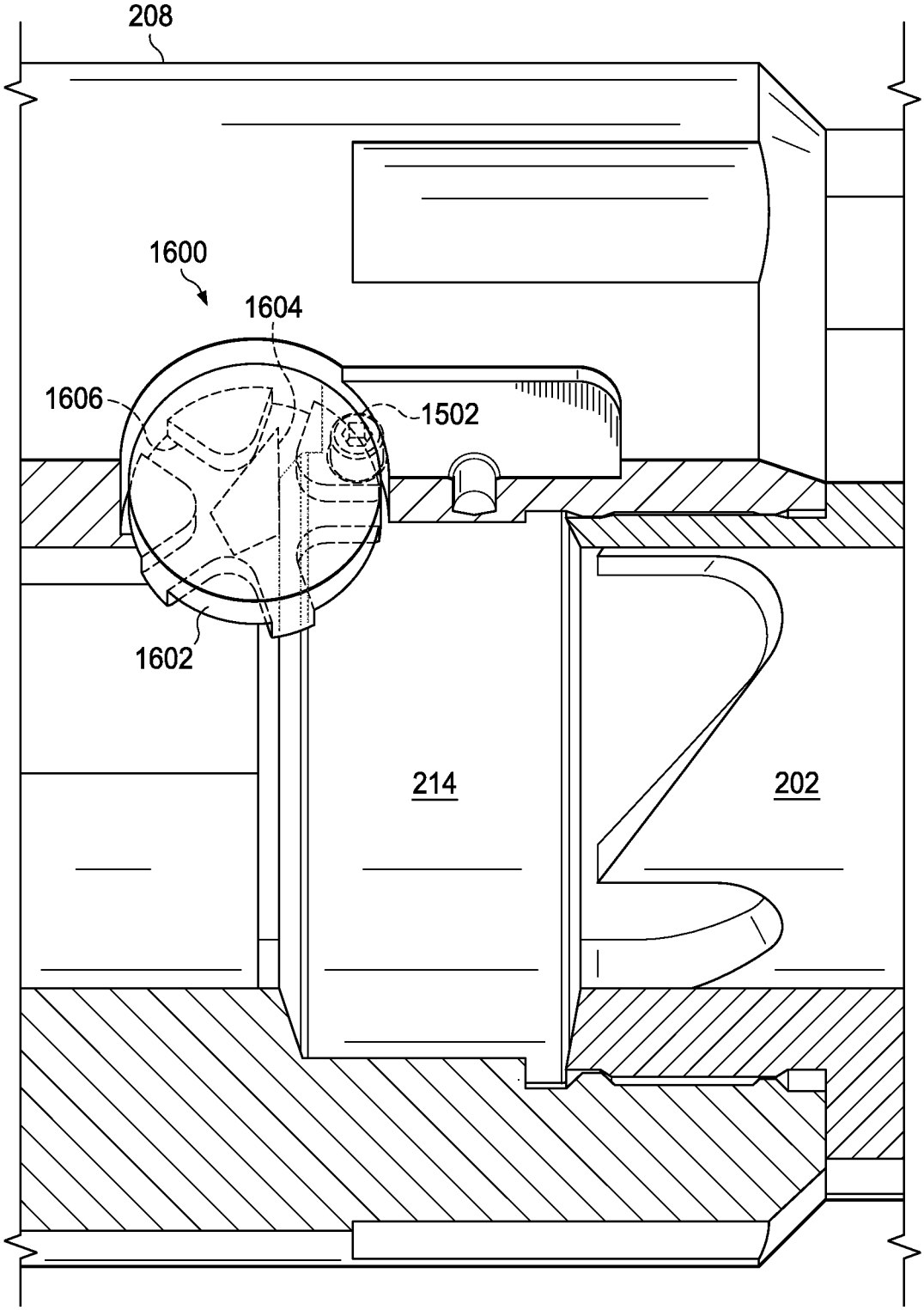
FIG. 17 illustrates an isometric partial cross section of an actuation assembly according to an embodiment of the present disclosure.

In an embodiment as shown in FIGS. 15-17, the rotating lug ring 214 comprises an indicator 1502 disposed on the outer surface of the rotating lug ring 214 and adjacent a recess 1504 disposed on an edge of the rotating lug ring 214. The indicator 1502 may comprise a protrusion such as a pin extending from the outer surface of the rotating lug ring 214. The indicator 1502 may extend a sufficient distance from the surface of the rotating lug ring 214 to engage a gear 1606 on the geared wheel 1602. In an embodiment, a single indicator 1502 may be disposed on the rotating lug ring 214 to produce a single actuation of the geared wheel 1602 for each rotation of the rotating lug ring 214. The outer mandrel 208 of the actuation assembly may be configured with a slot or recess through which the indicator 1502 may travel during rotation of the rotating lug ring 214 about the inner mandrel 202. In some embodiments a plurality of indicators 1502 may be disposed on the rotating lug ring 214, each with a corresponding recess 1504, to produce a plurality of actuations of the geared wheel 1602 for each rotation of the rotating lug ring 214. The recess 1504 may comprise a notch disposed in an edge of the rotating lug ring 214. The recess 1504 may have a width and length sufficient to allow the guide 1604 to rotate into the recess 1504 during the actuation of the geared wheel 1602.

The limiting mechanism 1600 comprises a geared wheel 1602 with a guide 1604. The guide 1604 may comprise any shape allowing for the geared wheel 1602 to rotate during actuation while engaging and limiting the further rotation of the rotating lug ring 214 upon a predetermined number of actuations. The flat sides 1618 of the guide 1604 may be configured to slidingly engage the edge of the rotating lug ring 214 until actuation of the geared wheel 1602 due to the interaction of the indicator 1502 with a gear 1606. The shape of the edge of the guide 1604 may correspond to the shape of the edge of the rotating lug ring 214. Upon actuation, the guide 1604 may rotate with a portion of the guide 1604 passing into the recess 1504 in the rotating lug ring 214 during the actuation. In an embodiment, the guide 1604 may have the same number of sides as the maximum number of actuations of the geared wheel 1602. The guide 1604 may have a height sufficient to allow the guide 1604 to rotate about a recess in the outer mandrel 208 or on the inner mandrel 202 while positioning the gears 1606 adjacent to the rotating lug ring 214 with a portion of the geared wheel 1602 and gears 1606 over the rotating lug ring 214. The gears 1606 may comprise any shape configured to engage the indicator 1502 and produce a partial rotation of the geared wheel 1602.

In an embodiment shown in FIG. 16, the guide 1604 has a wedge shape with a plurality of flat sides 1618. The guide 1604 may be positioned so that a lengthened portion with length 1616 is formed in alignment with one of the gears 1606. The sides of the guide 1604 may be configured so that the distance 1610, 1611, 1612, 1614 between a center point 1608 of the geared wheel 1602 and the side of the guide 1604 aligned with a gear 1606 is less than or approximately equal to a distance between the center point 1608 and the edge 1506 of the rotating lug ring 214. The point between each of these positions may have a length that is greater than the distance between the center point 1608 and the edge 1506 of the rotating lug ring 214, but that is less than the distance between the center point 1608 and the edge 1508 of the recess 1504 in the rotating lug ring 214. The lengthened portion may have a length 1616 that is greater than the distance between the center point 1608 and the edge 1506 of the rotating lug ring 214 and greater than the distance between the center point 1608 and the edge 1508 of the recess 1504 in the rotating lug ring 214, which may allow the lengthened portion to engage the recess 1504 and lock the rotating lug ring 214.

In an embodiment as shown in FIG. 17, the limiting mechanism 1600 may be disposed in the outer mandrel 208 adjacent the rotating lug ring 214 using a retaining mechanism. The retaining mechanism may be configured to retain the geared wheel 1602 in position adjacent to the rotating lug ring 214 and may engage the outer mandrel 208 using a threaded connection, a pressure fitted connection, or any other connection known to one of ordinary skill in the art. In an embodiment, a biasing mechanism may optionally be disposed between the geared wheel 1602 and the retaining mechanism to bias the geared wheel 1602 inward towards the rotating lug ring 214. The biasing mechanism may comprise a spring, elastomeric element, or the like.

Figure 18:
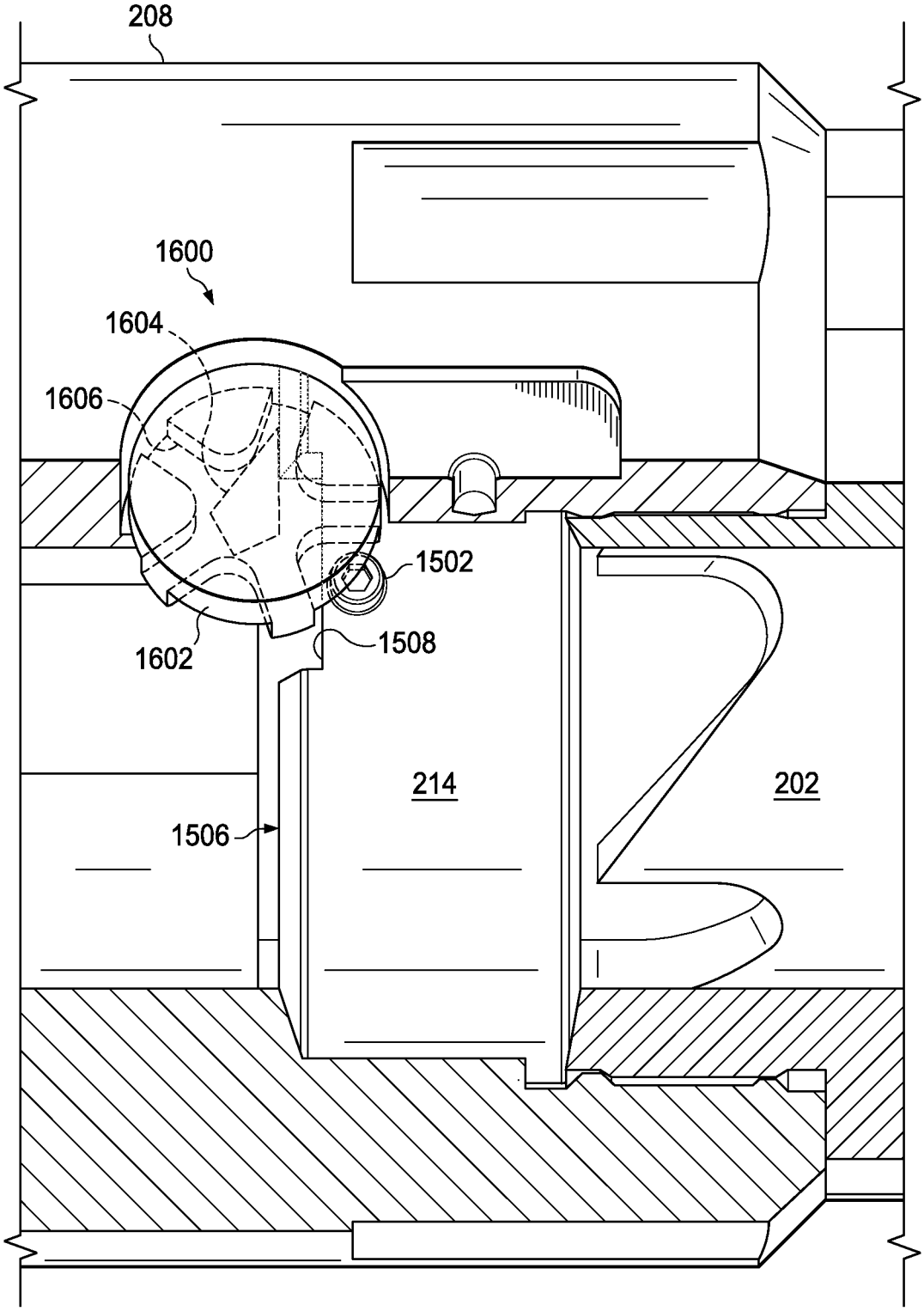
FIG. 18 illustrates another isometric partial cross section of an actuation assembly according to an embodiment of the present disclosure.
Figure 19:
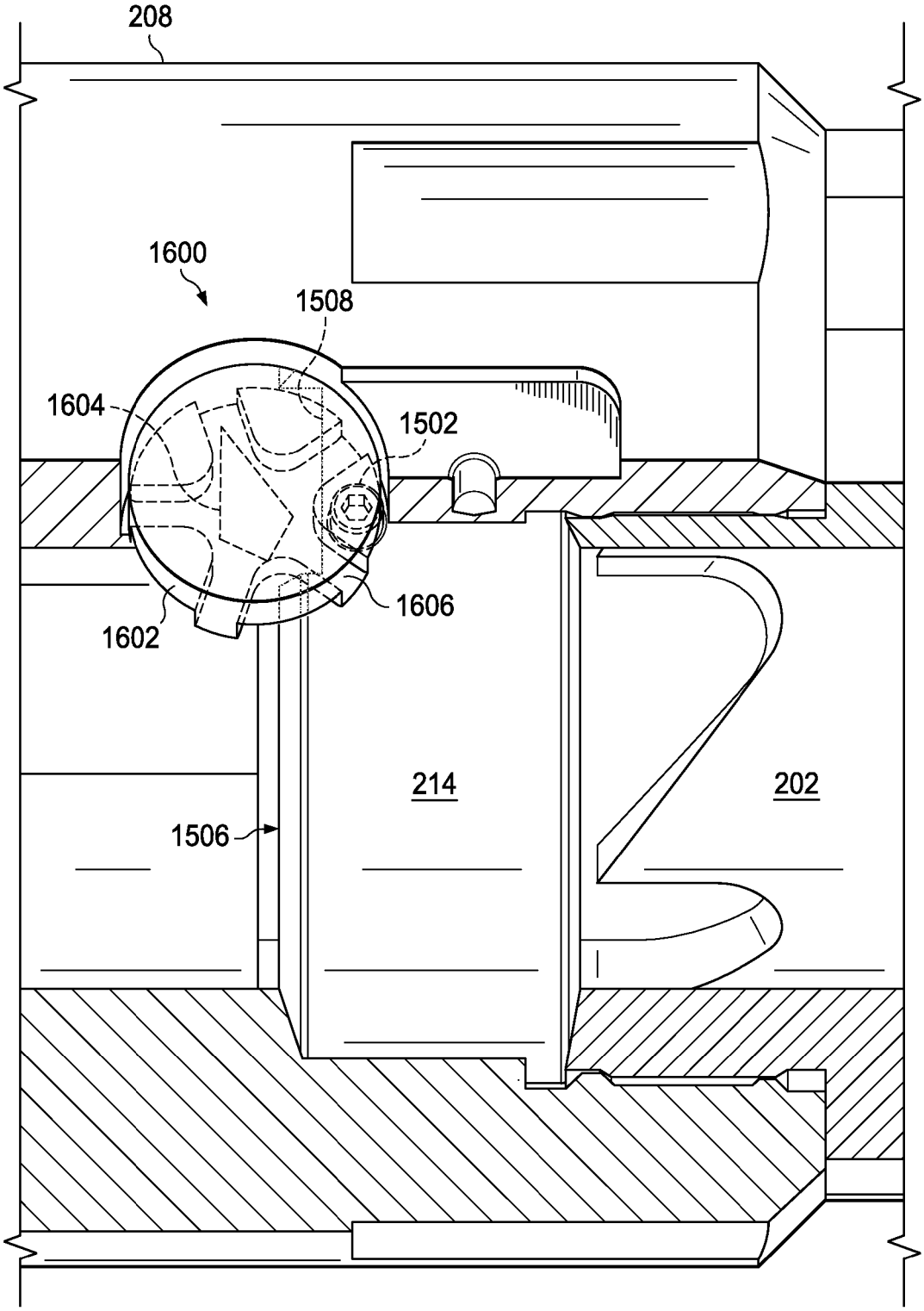
FIG. 19 illustrates still another isometric partial cross section of an actuation assembly according to an embodiment of the present disclosure.
Figure 20:
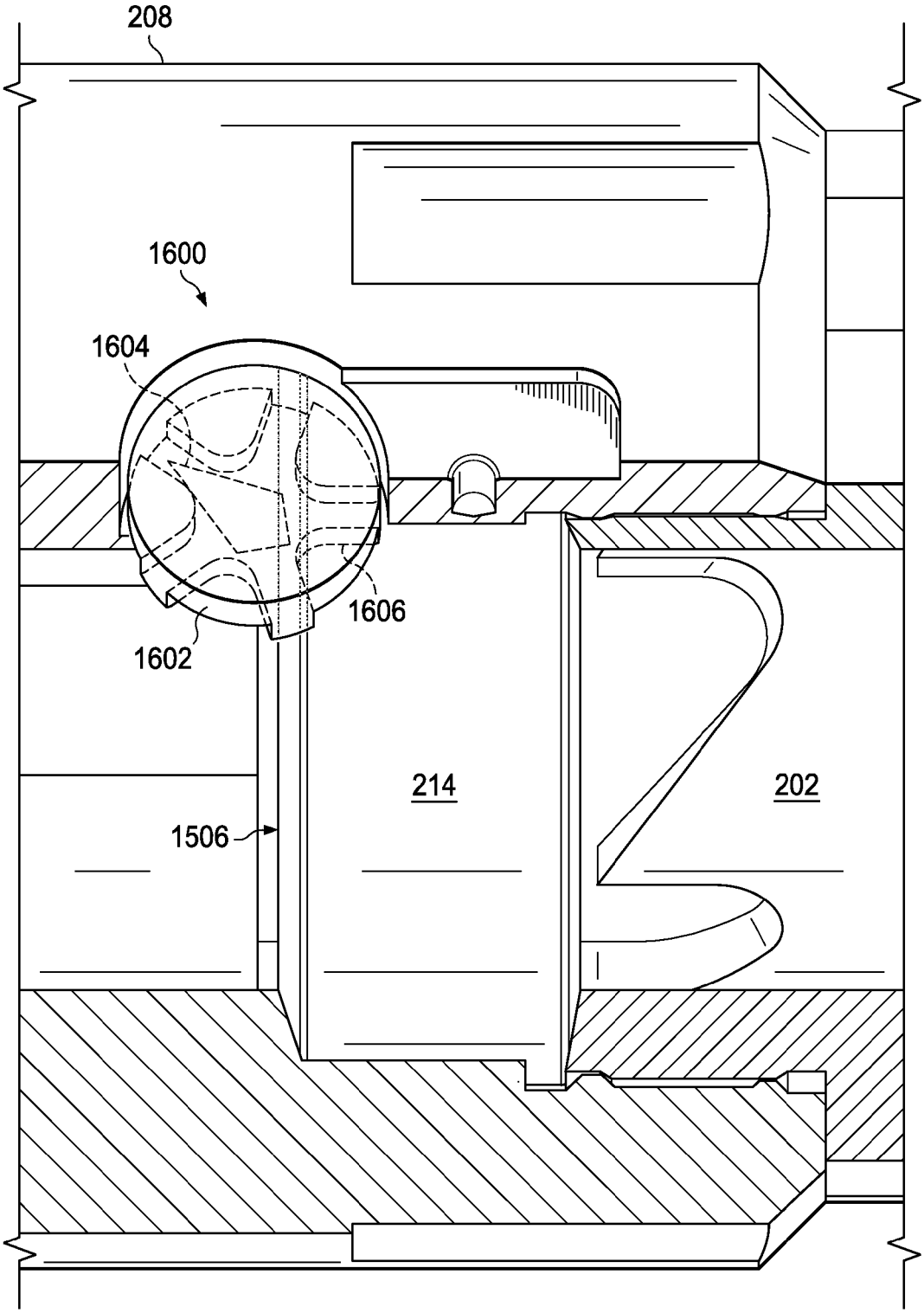
FIG. 20 illustrates yet another isometric partial cross section of an actuation assembly according to an embodiment of the present disclosure.

In an embodiment, the limiting mechanism 1600 may operate as shown in FIGS. 17-21. The initial positioning of the geared wheel 1602 with respect to the rotating lug ring 214 and the indicator 1502 is shown in FIG. 17. The guide 1604 may be aligned with the elongated portion aligned in the direction of rotation of the rotating lug ring 214. During longitudinal cycling of the inner mandrel 202, the rotating lug ring 214 may rotate about the inner mandrel 202. As shown in FIG. 18, the indicator 1502 may engage a gear 1606 extending over the rotating lug ring 214 as the rotating lug ring 214 nears a complete rotation. It may be noted that the geared wheel 1602 does not rotate during the rotation of the rotating lug ring 214 except when the indicator 1502 engages a gear 1606 due to the interaction of a flat side of the guide 1604 with the edge 1506 of the rotating lug ring 214. During the rotation of the rotating lug ring 214, the flat side of the guide 1604 disposed in contact with the edge 1506 of the rotating lug ring 214 may prevent any rotation of the geared wheel 1602 since any rotation would result in a point of the guide 1604 abutting the edge 1506 of the rotating lug ring 214, which cannot occur until the recess 1504 is aligned with the guide 1604 upon the engagement of the indicator 1502 with the gear 1606. As shown in FIG. 19, the interaction of the indicator 1502 with the gear 1606 results in a partial rotation of the geared wheel 1602. The guide 1604 rotates with the geared wheel 1602 and a peak of the guide 1604 passed into the recess 1504 during the rotation. As shown in FIG. 20, the geared wheel 1602 is maintained in position with respect to the rotating lug ring 214 after the indicator passes out of engagement with the gear 1606 due to the interaction of the flat side of the guide 1604 with the edge 1506 of the rotating lug ring 214.

Figure 21:
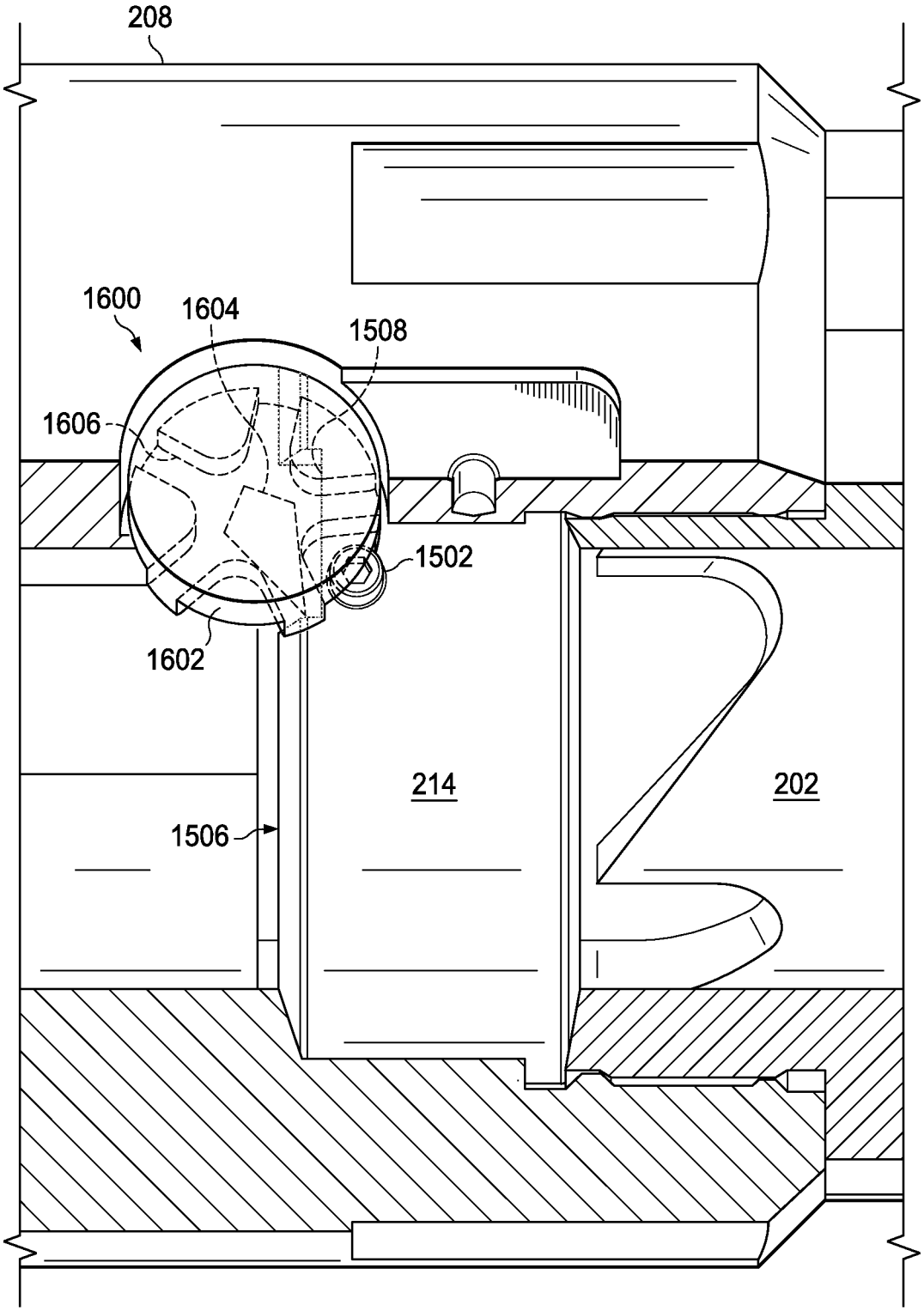
FIG. 21 illustrates another isometric partial cross section of an actuation assembly according to an embodiment of the present disclosure.

The actuation process may be repeated during each pass of the indicator 1502 on the rotating lug ring 214 until the final actuation as shown in FIG. 21. During the final actuation, the lengthened portion of the guide 1604 passes into the recess 1504. Since the lengthened portion of the guide 1604 has a length greater than the distance between the center of the geared wheel 1602 and the inner edge 1508 of the recess 1504, the guide 1604 engages the recess 1504, and the indicator 1502 remains engaged with the gear 1606. The rotating lug ring 214 is prevented from rotating backwards due to the interaction of the J-slot with the lug. As a result, the rotating lug ring 214 may be locked into position, thereby locking the actuation assembly.

When the actuation assembly is in the locked position, the actuation assembly may be conveyed out of the wellbore, and the limiting mechanism 1600 may be reset for an additional use. The limiting mechanism 1600 may be reset by removing the retaining mechanism and repositioning the geared wheel 1602 to the desired location with respect to the indicator 1502. For example, the geared wheel 1602 may be reset with the lengthened portion of the guide 1604 in the desired position. The optional biasing mechanism and retaining mechanism may then be re-engaged with the outer mandrel 208 to provide an actuation assembly configured for use within the wellbore.

The number of gears may determine the maximum number of actuations of the limiting mechanism 1600 before locking the rotating lug ring 214, and thereby locking the actuation assembly. In an embodiment as shown in FIG. 17, the indicator 1502 may begin in the space between two of the gears 1606 and may then rotate into a locked position as a result of four actuations of the geared wheel 1602. It can be seen that a greater number of gears 1606 on the geared wheel 1620 may allow for a greater number of actuations of the limiting mechanism 1600 before locking the rotating lug ring 214. The greater number of actuations of the limiting mechanism 1600 may allow for a greater number of setting/unsetting cycles of the actuation assembly before locking the actuation assembly. In an embodiment, the geared wheel 1602 may comprise three gears, four gears, five gears, six gears, seven gears, eight gears, nine gears, or ten gears to allow for a maximum number of two actuation cycles of the limiting mechanism 1600, three actuation cycles of the limiting mechanism 1600, four actuation cycles of the limiting mechanism 1600, five actuation cycles of the limiting mechanism 1600, six actuation cycles of the limiting mechanism 1600, seven actuation cycles of the limiting mechanism 1600, eight actuation cycles of the limiting mechanism 1600, or nine actuation cycles of the limiting mechanism 1600, respectively. In an embodiment, the limiting mechanism 1600, the rotating lug ring 214, and the slot 220 on the inner mandrel 202 may be configured to provide a maximum of four, six, eight, ten, twelve, fourteen, sixteen, or eighteen setting/unsetting cycles of the actuation assembly.

The initial positioning of the geared wheel 1602 may be chosen to allow for a desired number of settings and/or unsettings of the actuation assembly. The use of a limiting mechanism 1600 comprising a geared wheel 1602 may allow for multiple rotations of the rotating lug ring 214, and selection of the position of the lengthened portion of the guide 1604 relative to the indicator 1502 may allow for any degree of rotation equal to or less than the maximum number of rotations available. In an embodiment as shown in FIG. 17, the indicator 1502 may be initially disposed between adjacent gears in a first position 1621 with the lengthened portion of the guide 1604 disposed along the rotating lug ring 214 in the direction of rotation. This position may allow for the maximum number of actuations of the geared wheel 1602 and limiting mechanism 1600. For example, the positioning of the geared wheel 1602 as shown in FIG. 17 may result in four actuations of the limiting mechanism 1600 through four full rotations of the rotating lug ring 214 prior to the lengthened portion of the guide 1604 engaging the recess 1504 in the rotating lug ring 214, thereby locking the actuation assembly. In an embodiment using the continuous J-slot shown in FIG. 3, the four full rotations of the rotating lug ring 214 may allow for a maximum of eight setting/unsetting cycles of the actuation assembly.

In an embodiment, the indicator 1502 may be initially disposed in the second position 1622. This position may allow for less than the maximum number of actuations of the limiting mechanism 1600. For example, the positioning of the indicator 1502 in the second position 1622 illustrated in FIG. 16 may result in three actuations of the limiting mechanism 1600 through three full rotations of the rotating lug ring 214 prior to the lengthened portion of the guide 1604 engaging the recess 1504 in the rotating lug ring 214, thereby locking the actuation assembly. In an embodiment using the continuous J-slot shown in FIG. 3, the three full rotations of the rotating lug ring 214 may allow for six setting/unsetting cycles of the actuation assembly.

In another embodiment, the indicator 1502 may be initially disposed in the third position 1623. The positioning of the indicator 1502 in the third position 1623 illustrated in FIG. 16 may result in two actuations of the limiting mechanism 1600 through two full rotations of the rotating lug ring 214 prior to the lengthened portion of the guide 1604 engaging the recess 1504 in the rotating lug ring 214, thereby locking the actuation assembly. In an embodiment using the continuous J-slot shown in FIG. 3, the two full rotations of the rotating lug ring 214 may allow for four setting/unsetting cycles of the actuation assembly.

In still another embodiment, the indicator 1502 may be initially disposed in the fourth position 1625. The positioning of the indicator 1502 in the fourth position 1624 illustrated in FIG. 16 may result in one actuation of the limiting mechanism 1600 through one full rotation of the rotating lug ring 214 prior to the lengthened portion of the guide 1604 engaging the recess 1504 in the rotating lug ring 214, thereby locking the actuation assembly. In an embodiment using the continuous J-slot shown in FIG. 3, the one full rotation of the rotating lug ring 214 may allow for two setting/unsetting cycles of the actuation assembly.

Additional features may allow for partial cycles and/or additional cycles. In an embodiment, the use of two indicators 1502 disposed on different halves of the rotating lug ring 214 may allow for two actuations of the limiting mechanism 1600 for each rotation of the rotating lug ring 214. An odd number of setting/unsetting cycles of the actuation assembly may then be achieved using the limiting mechanism 1600. In an embodiment, three or more indicators 1502 may be disposed on different portions of the rotating lug ring 214. For example, four indicators 1502 may be used to achieve four actuations of the limiting mechanism 1600 for each rotation of the rotating lug ring 214. This embodiment may allow for partial setting/unsetting actuation cycles to be achieved (e.g., a setting or an unsetting of the actuation assembly). Thus, the configuration of the inner mandrel 202, the rotating lug ring 214, and the limiting mechanism 1600 may be coordinated to allow for a desired maximum number of setting/unsetting cycles of the actuation assembly. The actuation assembly may then be configured to allow for any portion of the maximum number of setting/unsetting cycles by proper selection of the initial geared wheel 1602 and guide 1604 position relative to the indicator 1502 on the rotating lug ring 214.

While the embodiment shown in FIGS. 15-21 is described in terms of an indicator engaging a geared wheel and guide, additional configurations may be used to achieve the same result of limiting the rotation of the rotating lug ring 214. In an embodiment, a lock may be disposed on the end of a gear to limit the rotation of the geared wheel upon a sufficient number of actuations. For example, a hook structure could be included on the end of a locking gear that is configured to lockingly engage the indicator. Upon rotating the geared wheel into position, the hook on the end of the gear could engage the indicator rather than simply rotating the geared wheel. In an embodiment, additional suitable indicator and guide structures may be used to cause the geared wheel to rotate into a locking position.

Referring to FIGS. 1 and 2, the actuation assembly 200 comprising a limiting mechanism may be used in a wellbore 114 in a servicing operation. In an embodiment, the actuation assembly 200 comprising the rotating lug ring 214 disposed about an inner mandrel 202 and the actuation assembly 200 may be disposed within the wellbore 114 as part of a wellbore tubular string 120. In an embodiment, the rotating lug ring 214 may interact with a continuous slot 220, which in some embodiments, may be a continuous J-slot. The actuation assembly 200 may be actuated a predetermined number of times. In an embodiment, the actuation of the actuation assembly 200 may be used to actuate one or more servicing tools or components, which may be useful for a variety of purposes such as one or more servicing operations. In an embodiment, the actuation assembly 200 may be used to actuate a packer and/or one or more auxiliary tools such as a settable plug (e.g., a retrievable bridge plug), a fluid sampling device, jetting tools, fracturing tools, measurement tools, etc. Upon cycling the actuation assembly 200 through a desired number of cycles, the limiting mechanism may lock the rotating lug ring 214, thereby preventing any further rotation of the rotating lug ring 214. The locking of the rotating lug ring 214 may lock the actuation assembly 200 in a desired position. In an embodiment, the actuation assembly 200 may be locked in an unset position, which may aid in retrieving the wellbore tubular string 120 to the surface of the wellbore 114.

The actuation assembly 200 may then be reset and used in one or more subsequent servicing operations. In an embodiment, the limiting mechanism may be removed from the actuation assembly 200 and reset to allow a predetermined number of setting/unsetting cycles of the actuation assembly 200 to be performed. The predetermined number of setting/unsetting cycles may comprise any number of cycles or portions thereof that are equal to or less than the maximum designed number of cycles. In an embodiment, the reset actuation assembly 200 may be positioned in a wellbore 114 as part of a wellbore tubular string 120 and the actuation assembly 200 may be actuated a predetermined number of times. This process may be repeated a plurality of times, and during each repetition, the predetermined number of setting/unsetting cycles may be the same or different.

In an embodiment, the actuation assembly 200 comprising a limiting mechanism may be used in a wellbore 114 in a servicing operation using one or more servicing tools. In an embodiment, the actuation assembly 200 comprising the rotating lug ring 214 disposed about an inner mandrel 202 and the actuation assembly 200 may be disposed within the wellbore 114 as part of a wellbore tubular string 120 that comprise a settable packer and an auxiliary tool. The wellbore tubular string 120 may be placed within the well and the actuation assembly 200 may be used to actuate the packer 140 to isolate a zone of the wellbore. The auxiliary tool may then be used to perform a stimulation operation (e.g., perforate and/or fracture the isolated zone), a surveying operation (e.g., sample fluid and/or the formation), and/or a completion operation (e.g., cementing, gravel packing, etc.). The actuation assembly 200 may then be cycled to release the packer 140. The wellbore tubular string 120 may then be conveyed to another zone of interest and the actuation assembly 200 may be actuated to set the packer 140 and isolate the second zone of interest. After performing one or more servicing operations in the second zone of interest, the actuation assembly 200 may then be cycled to release the packer 140. This process may be repeated a plurality of times. Upon cycling the actuation assembly 200 through a desired number of cycles corresponding to the desired number of setting/unsetting cycles of the packer, the limiting mechanism may lock the rotating lug ring 214, thereby preventing any further rotation of the rotating lug ring 214. The locking of the rotating lug ring 214 may lock the actuation assembly 200 in a desired position corresponding to an unset position of the packer 140. The wellbore tubular string 120 comprising the actuation assembly 200, the packer 140, and the auxiliary tool may then be retrieved to the surface of the wellbore 114. The actuation assembly 200 may then be reset and used in one or more subsequent servicing operations, which may or may not include additional servicing operations.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A mechanism for use in a wellbore servicing tool comprising:

a continuously rotating ring within a servicing tool; and a limiting mechanism configured to engage the ring and lock the ring against further rotational motion upon a predetermined degree of rotation of the ring, wherein the limiting mechanism is configured to prevented the continuously rotating ring from rotating in response longitudinal motion of the ring relative to the servicing tool when the ring is locked against further rotational motion.

2. The mechanism of claim 1, wherein the limiting mechanism comprises a pin configured to engage a corresponding recess disposed on the ring upon an alignment of the pin and the corresponding recess.

3. The mechanism of claim 2, further comprising a biasing mechanism to bias the pin into contact with the ring.

4. The mechanism of claim 2, wherein the predetermined degree of rotation of the ring is less than or equal to a single rotation of the ring.

5. The mechanism of claim 1, wherein the limiting mechanism comprises a follower disk comprising a follower pin, wherein the follower pin is configured to engage a guide feature disposed on the ring.

6. The mechanism of claim 5, wherein the guide feature comprises a groove with an end wall, and wherein the limiting mechanism is configured to lock the ring upon the engagement of the follower pin with the end wall of the groove.

7. The mechanism of claim 5, Wherein the predetermined degree of rotation of the ring is less than or equal to four rotations of the ring.

8. The mechanism of claim 1, wherein the limiting mechanism comprises a ratchet mechanism that is activated by an indicator disposed on the ring, and wherein the ratchet mechanism is configured to release a retaining pm that engages a recess disposed on the ring upon a predetermined number of activations of the ratchet mechanism, wherein the limiting mechanism is configured to lock the ring upon the engagement of the retaining pin with the recess.

9. The mechanism of claim 8, wherein the predetermined degree of rotation of the ring is less than or equal to seven rotations of the ring.

10. The mechanism of claim 1, Wherein the limiting mechanism comprises a geared wheel comprising a plurality of gears and a guide, wherein the gears are configured to engage an indicator disposed on the ring, and Wherein the guide is configured to engage a recess disposed on the ring upon a predetermined number of activations of the geared wheel, wherein the limiting mechanism is configured to lock the ring upon engagement of the guide with the recess.

11. The mechanism of claim 10, wherein the predetermined degree of rotation of the ring is less than or equal to nine rotations of the ring.

12. An actuation assembly for use in a wellbore comprising:

an inner mandrel comprising a continuous slot;

a rotating lug ring comprising a lug, wherein the rotating lug ring is disposed about the inner mandrel and the lug engages the continuous slot; and a limiting mechanism configured to engage an outer circumferential surface of the rotating lug ring and lock the rotating lug ring against further rotational motion upon a predetermined degree of rotation of the rotating lug ring about the inner mandrel based on the engagement between the limiting mechanism and the outer circumferential surface of the rotating lug ring.

13. The actuation assembly of claim 12, further comprising an outer mandrel disposed about the inner mandrel and the rotating lug ring, wherein the limiting mechanism is disposed within the outer mandrel.

14. The actuation assembly of claim 12, wherein the continuous slot is a continuous J-slot.

15. The actuation assembly of claim 12, further comprising a servicing tool coupled to the actuation assembly.

16. The actuation assembly of claim 15, wherein the limiting mechanism comprises a pin configured to engage a corresponding recess disposed on the rotating lug ring upon an alignment of the pin and the corresponding recess.

17. The actuation assembly of claim 16, wherein the predetermined degree of rotation of the rotating lug ring is configured to provide less than or equal to two setting/unsetting cycles of the servicing tool.

18. The actuation assembly of claim 15, wherein the limiting mechanism comprises a follower disk comprising a follower pin, wherein the follower pin is configured to engage a groove disposed on the rotating lug ring.

19. The actuation assembly of claim 18, wherein the predetermined degree of rotation of the rotating lug ring is configured to provide less than or equal to eight setting/unsetting cycles of the servicing tool.

20. The actuation assembly of claim 15, Wherein the limiting mechanism comprises a ratchet mechanism configured for activation by an indicator disposed on the rotating lug ring, and wherein the ratchet mechanism is configured to allow a retaining pin to engage a recess disposed on the rotating lug ring upon a predetermined number of activations of the ratchet mechanism, wherein the limiting mechanism is configured to lock the rotating lug ring upon the engagement of the retaining pin with the recess.

21. The actuation assembly of claim 20, wherein the predetermined degree of rotation of the rotating lug ring and the predetermined number of activations of the ratchet mechanism are configured to provide less than or equal to fourteen setting/unsetting cycles of the servicing tool.

22. The actuation assembly of claim 15, wherein the limiting mechanism comprises a geared wheel comprising a plurality of gears and a guide, wherein the gears are configured to engage an indicator disposed on the rotating lug ring, and wherein the guide is configured to engage a recess disposed on the rotating lug ring upon a predetermined number of activations of the geared wheel, wherein the limiting mechanism is configured to lock the ring upon engagement of the guide with the recess.

23. The actuation assembly of claim 22, wherein the predetermined degree of rotating of the rotating lug ring and the predetermined number of activations of the geared wheel are configured to provide less than or equal to eighteen setting/unsetting cycles of the servicing tool.

24. A method of servicing a wellbore comprising:

placing an actuation assembly coupled to a servicing tool within a wellbore, wherein the actuation assembly comprises a rotating lug ring engaging a continuous slot;

activating the servicing tool a first predetermined number of times with the actuation assembly, wherein the servicing tool is activated using longitudinal motion of at least one of the rotating ring or the continuous slot; and locking the actuation assembly into a locked position after activating the servicing tool the first predetermined number of times, wherein the actuation assembly is prevented from being actuated out of the locked position by the longitudinal motion when in the locked position.

25. The method of claim 24, wherein the continuous slot is a continuous J-slot.

26. The method of claim 24, wherein the actuation assembly comprises a geared wheel comprising a plurality gears and a guide, and wherein the gears are configured to engage an indicator disposed on the rotating lug ring engaging the continuous slot.

27. The method of claim 26, wherein locking the actuation assembly comprises engaging the guide with a recess disposed on the rotating lug ring upon activating the servicing tool the first predetermined number of times to lock the rotating lug ring upon engagement of the guide with the recess.

28. The method of claim 27, wherein the predetermined number of times is less than or equal to eighteen activations of the servicing tool.

29. The method of claim 24, further comprising:

removing the actuation assembly from the wellbore;

resetting the actuation assembly;

replacing the actuation assembly coupled to the servicing tool within the wellbore;

activating the servicing tool a second predetermined number of times with the actuation assembly; and locking the actuation assembly into a second position after activating the servicing tool the second predetermined number of times.

30. The method of claim 29, wherein the first predetermined number of times and the second predetermined number of times are different.

* * * * *